US009702212B2

(12) United States Patent
Breda et al.

(10) Patent No.: US 9,702,212 B2
(45) Date of Patent: Jul. 11, 2017

(54) HORIZONTAL VERTICAL DEEPWATER TREE

(71) Applicant: FMC Technologies, Inc., Houston, TX (US)

(72) Inventors: Jøren Breda, Nesøya (NO); Egil Åsli, Kongsberg (NO); Eric R. Smedstad, League City, TX (US); Richard Murphy, Houston, TX (US); Paul L. Riley, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 14/438,850

(22) PCT Filed: Nov. 6, 2013

(86) PCT No.: PCT/US2013/068777
§ 371 (c)(1),
(2) Date: Apr. 27, 2015

(87) PCT Pub. No.: WO2014/074616
PCT Pub. Date: May 15, 2014

(65) Prior Publication Data

US 2015/0275608 A1 Oct. 1, 2015

Related U.S. Application Data

(60) Provisional application No. 61/723,209, filed on Nov. 6, 2012.

(51) Int. Cl.

| | |
|---|---|
| ***E21B 33/035*** | (2006.01) |
| ***E21B 34/04*** | (2006.01) |
| ***E21B 43/12*** | (2006.01) |

(52) U.S. Cl.
CPC ..... *E21B 33/035* (2013.01); *E21B 34/04* (2013.01); *E21B 43/128* (2013.01); *E21B 43/129* (2013.01)

(58) Field of Classification Search
CPC .. E21B 33/035; E21B 33/0355; E21B 33/043; E21B 34/04; E21B 43/01; E21B 43/129; E21B 43/128
(Continued)

(56) References Cited

U.S. PATENT DOCUMENTS 4,804,045 A * 2/1989 Reed ..... E21B 33/03 166/313
6,076,605 A * 6/2000 Lilley ..... E21B 33/035 166/344
(Continued)

FOREIGN PATENT DOCUMENTS

EP 2 535 503 A2 12/2012
GB 2 346 630 A 8/2000
(Continued)

*Primary Examiner* — Matthew R Buck
(74) *Attorney, Agent, or Firm* — Henry C. Query, Jr.

(57) ABSTRACT

A subsea hydrocarbon production system comprises a tubing hanger which is positioned at an upper end of a well bore, a tubing string which extends from the tubing hanger into the well bore and is fluidly connected to the tubing hanger production bore, and a christmas tree which is positioned above the tubing hanger. The christmas tree comprises a production bore which is fluidly connected to the tubing hanger production bore, a production outlet which is connected to the production bore, a first barrier element which is positioned in the production outlet, and a first closure device which is positioned in the production bore above the production outlet. In this manner access from above the christmas tree through the production bore does not require passage through a barrier element.

28 Claims, 21 Drawing Sheets

(58) Field of Classification Search
USPC ..... 166/368
See application file for complete search history.

(56) References Cited

U.S. PATENT DOCUMENTS

| | | | | |
|---|---|---|---|---|
| 6,378,613 | B1 * | 4/2002 | Kent | E21B 33/035 166/368 |
| 6,675,900 | B2 | 1/2004 | Baskett et al. | |
| 6,776,230 | B2 * | 8/2004 | Collie | E21B 43/128 166/337 |
| 6,966,383 | B2 * | 11/2005 | Milberger | E21B 33/043 166/368 |
| 7,331,396 | B2 * | 2/2008 | Reimert | E21B 33/035 166/319 |
| 7,677,320 | B2 * | 3/2010 | Shaw | E21B 43/128 166/339 |
| 8,157,015 | B2 * | 4/2012 | Voss | E21B 33/0355 166/344 |
| 8,371,385 | B2 * | 2/2013 | Lewis | E21B 33/035 166/341 |
| 9,151,131 | B2 * | 10/2015 | Drablier | E21B 33/0355 |
| 2003/0089501 | A1 * | 5/2003 | Hartmann | E21B 33/035 166/348 |
| 2010/0139926 | A1 | 6/2010 | Sbordone et al. | |
| 2011/0203803 | A1 | 8/2011 | Zemlak et al. | |
| 2011/0300008 | A1 * | 12/2011 | Fielder | E21B 19/002 417/410.3 |
| 2014/0048277 | A1 * | 2/2014 | June | E21B 33/035 166/348 |

FOREIGN PATENT DOCUMENTS

| | | | | |
|---|---|---|---|---|
| GB | GB 2397312 | A * | 7/2004 | E21B 33/035 |
| GB | 2 446 496 | A | 8/2008 | |
| NO | WO 2012148288 | A1 * | 11/2012 | E21B 33/076 |
| WO | WO 2012/045771 | A2 | 4/2012 | |
| WO | WO 2012/148288 | A1 | 11/2012 | |

* cited by examiner

HORIZONTAL VERTICAL DEEPWATER TREE

BACKGROUND OF THE INVENTION

The present invention is directed to a christmas tree for a subsea hydrocarbon production system. More particularly, the invention is directed to a tree which combines the ease of retrieval associated with vertical christmas trees with the ease of power feedthrough associated with horizontal christmas trees.

Vertical christmas trees ("VXT's") with fail safe closed ("FSC") barrier valves in the vertical bore are not compatible with hanging off elements in the top of the tree. Horizontal christmas trees ("HXT's") are not easy retrievable, as the tubing hanger is suspended in the tree.

SUMMARY OF THE INVENTION

In accordance with the present invention, therefore, a subsea hydrocarbon production system is provided which comprises a tubing hanger which is positioned at an upper end of a well bore, the tubing hanger including a tubing hanger production bore; a tubing string which extends from the tubing hanger into the well bore and is fluidly connected to the tubing hanger production bore; and a christmas tree which is positioned above the tubing hanger and which comprises a production bore which is fluidly connected to the tubing hanger production bore; a production outlet which is connected to the production bore; a first barrier element which is positioned in the production outlet; and a first closure device which is positioned in the production bore above the production outlet. In this manner access from above the christmas tree through the production bore does not require passage through a barrier element.

In accordance with one embodiment of the invention, the subsea hydrocarbon production system comprises a second closure device which is positioned in the production bore above the first closure device such that the first and second closure devices provide two pressure barriers between the well bore and the environment during the production mode of operation of the christmas tree. In this embodiment, the second closure device may comprise a tree cap or a wireline plug. In another aspect of the invention, the subsea hydrocarbon production system comprises a third closure device which is positioned in the production bore below the production outlet.

In accordance with another embodiment of the invention, the subsea hydrocarbon production system comprises a downhole equipment device which is positioned in the tubing string, the downhole equipment device being connected to a suspension string which is connected to a downhole equipment hanger that is secured to the production bore above the production outlet; wherein the downhole equipment device is installed through the first closure device. In this embodiment, the subsea hydrocarbon production system may also comprise a second closure device which is positioned in the production bore below the production outlet; wherein the downhole equipment device is installed through both the first and second closure devices.

In addition, an end of the suspension string located in the downhole equipment hanger may be connected to an external power supply by a wet mate connector. In this embodiment, the wet mate connector may be connected to a power and/or utility feed through in a tree cap which is secured and sealed to the top of the christmas tree. Furthermore, the downhole equipment hanger may be positioned below the first closure device, in which event the wet mate connector is configured to extend through the first closure device. Alternatively, the end of the cable may be connected to a wet mate connector half which is configured to be engaged by a radial wet mate connector half mounted on the christmas tree.

In accordance with another embodiment of the invention, the subsea hydrocarbon production system comprises a downhole equipment device which is positioned in the tubing string, the downhole equipment device being connected to a suspension string which is connected to a downhole equipment hanger that is secured to the tubing hanger production bore; wherein the downhole equipment hanger is located below the first closure device. The subsea hydrocarbon production system may further comprise a second closure device which is positioned in the production bore below the production outlet; wherein the downhole equipment hanger is located below both the first and second closure devices.

The downhole equipment hanger may also comprise a number of axial through bores which permit the passage of fluid through the tubing hanger production bore. Furthermore, an end of the suspension string located in the downhole equipment hanger may be connected to an external power supply by a wet mate connector. In particular, the end of the suspension string may be connected to a wet mate connector half which is configured to be engaged by a radial wet mate connector half mounted on the christmas tree. Alternatively, the end of the suspension string located in the downhole equipment hanger may be connected via a suspension string extender to a termination head which in turn is connected to an external power supply by a wet mate connector. The wet mate connector may be connected to a power and/or utility feed through in a tree cap which is secured and sealed to the top of the christmas tree. In one aspect of this embodiment, the downhole equipment hanger is positioned below the first closure device and the wet mate connector is configured to extend through the first closure device. In accordance with another aspect, the termination head is connected to a wet mate connector half which is configured to be engaged by a radial wet mate connector half mounted on the christmas tree.

In accordance with yet another embodiment of the invention, the subsea hydrocarbon production system comprises a hydraulic submersible pump which is positioned in the tubing string, the pump including a fluid power conduit which is connected to a downhole equipment hanger that is secured to the production bore above the production outlet and below the first closure device; and a pump conduit having a first end which is connectable to a source of pressurized fluid and a second end which is connected to production bore below the first closure device and above the downhole equipment hanger; wherein with the first closure device closed, pressurized fluid is communicated through the pump conduit, the production bore and the fluid power conduit to activate the pump. In this embodiment, fluid exhausted by the pump exits the production bore through the production outlet. This embodiment may also comprise a pump valve for controlling the flow of pressurized fluid through the pump conduit.

In accordance with another embodiment of the invention, a subsea hydrocarbon production system is provided which comprises a tubing hanger which is positioned at an upper end of a well bore, the tubing hanger including a tubing hanger production bore; a tubing string which extends from the tubing hanger into the well bore and is fluidly connected to the tubing hanger production bore; and a christmas tree which is positioned above the tubing hanger and which comprises an axially extending tree production bore which is connected to the tubing hanger production bore; a laterally extending production outlet which is connected to the tree production bore; a first barrier element which is positioned in the production outlet; and a second barrier element which is positioned in the tree production bore below the production outlet. The subsea hydrocarbon production system also includes a downhole equipment device which is positioned in the tubing string and is connected to a suspension string which in turn is connected to a downhole equipment hanger; wherein the downhole equipment hanger is landed in one of the tubing hanger production bore or the tree production bore below the second barrier element.

In this embodiment, the downhole equipment hanger may comprise a number of axial through bores which permit the passage of fluid through the tubing hanger production bore and the tree production bore. Also, the downhole equipment hanger may be landed in the tubing hanger production bore. Furthermore, the downhole equipment hanger may comprise a wet mate connector half to which an end of the suspension string is connected and which is configured to be engaged by a radial wet mate connector half for the supply of power and/or utilities to the downhole equipment device. In accordance with one aspect of this embodiment, the tubing hanger is landed in a wellhead located below the christmas tree and the radial wet mate connector is mounted on the wellhead. Alternatively, the tubing hanger may be landed in a tubing head located below the christmas tree, in which event the radial we mate connector is mounted on the tubing head. Further still, a portion of the downhole equipment hanger may extend into the tree production bore, in which event the radial wet mate connector is mounted on the christmas tree.

In accordance with a further embodiment of the invention, the downhole equipment hanger is landed in the tree production bore. In this embodiment, the downhole equipment hanger may comprise a wet mate connector half to which an end of the suspension string is connected and which is configured to be engaged by a radial wet mate connector half mounted on the christmas tree for the supply of power and/or utilities to the downhole equipment device. Alternatively, the downhole equipment hanger may be landed in the tubing hanger production bore and the tubing hanger may comprise a number of axially extending bypass flow ports which permit the passage of fluid around the downhole equipment hanger.

Thus, it may be seen that the christmas tree of the present invention addresses the following needs in the subsea hydrocarbon production industry: the need for easy retrieval, as the tubing hanger is landed in the wellhead or tubing head, not the christmas tree; the need for the possibility of hanging off elements in the tree through active barriers (i.e., barriers which are designed to be routinely actuated either manually or by remote control) in the vertical production bore; the need for the possibility of a power and/or utility feedthrough to downhole equipment, such as an electrical submersible pump ("ESP"), as in conventional HXT's; and the need for the possibility of increasing the bore diameter without having to increase the weight of the tree (i.e., the size of FSC valve actuators).

The inventive christmas tree increases the functionality of today's VXT's and provides a larger bore alternative to HXTs. The added functionality allows for the use of larger completions (e.g., 9⅝") with minimum or no impact on tree weight itself. The proposed tree configuration also facilitates the use of a power and/or utility feedthrough and a suspension string for downhole equipment, such as submersible pumps.

The christmas tree of the present invention comprises the following technical features: a tubing hanger suspended in a wellhead or a tubing head; an installable/retrievable downhole equipment hanger located in the vertical bore above or below the lateral production outlet; a power and/or utility feedthrough in the tree cap or radially through the tree or tubing head; actuated barrier elements (as that term is defined below) positioned in the production outlet, as in an HXT; actuated barrier elements having a size which is independent of the bore size of the vertical production bore; and optional closure devices (as that term is defined below) in the production bore above and/or below the production outlet (e.g., in a similar location as the PMV in a VXT).

Existing enhanced horizontal tree ("EHXT") systems are typically very costly to repair because, e.g., they require a mobile offshore drilling unit ("MODU") to pull the completion to enable the tree to be recovered for repair. In contrast, the christmas tree of the present invention can be installed on wire on a wellhead or a tubing head to minimize the cost associated with using mobile drilling rigs.

Also, the christmas tree of the invention is especially suitable where the need exists for hanging off elements extending down into the well, as the active actuated barrier elements are located in the production outlet, similar to an HXT.

For the foregoing, it may be seen that the christmas tree of the present invention offers the following benefits. The tree may facilitate vertical well access in large bore completions in a safe and cost effective manner. The tree may comprise a closure device in the vertical production bore below the production outlet which allows produced fluids to pass during normal production operations but can be closed in case of failure of a primary barrier element. The tree can accommodate additional closure devices in the form of non-conventional tree valves, such as coiled tubing strippers or variable bore pipe rams, thus facilitating the migration of some of the functionally that would exist in a well control package into the tree itself. This becomes practical because the tree is retrievable for maintenance without pulling the completion, particularly when downhole barriers are employed as intervention barriers, for example a combination of a surface controlled subsurface safety valve ("SC-SSV") and a surface controlled formation isolation valve ("SFIV"). The tree makes conventional tree weight and size less dependent on completion size by positioning the FSC barrier devices in the production outlet instead of the vertical production bore. Thus, the tree eliminates the need for large FSC barrier device actuators in the production bore. The tree facilitates power and/or utility feedthrough and the suspension of cable deployed downhole equipment, e.g., ESP's, in VXT-type subsea completions. The tree allows operators maximum flexibility, as downhole equipment can be installed at any time during the production mode of operation of the tree, and also allows them to standardize on a tree type whether they intend to deploy downhole equipment or not. Thus, the same tree can be used, thereby simplifying procurement and optimizing project cycle times. The tree provides the ability to add additional downhole functions into the completion, thus allowing multilaterals and downhole surveillance technologies, like fiber optic distributed temperature sensing, to be employed. The tree allows a downhole equipment hanger to be located in several locations in the vertical bore, e.g., below the closure devices in the vertical bore, between the closure devices, or above the closure devices.

The following are some of the main features of the christmas tree of the present invention. The tree provides improved well access because it only contains closure devices in vertical production bore. The closure devices in the vertical production bore may be replaced with barrier elements to ensure well control functionality as part of a shut-down or well control philosophy. These barrier elements may be fail safe closed. One or more of the closure devices in the vertical bore, which are typically designed for use only during well intervention, can be "unconventional" valves for a tree, such as a ball valve, a coiled tubing stripper valve or a pipe or wireline ram, to facilitate well intervention and optimize the well access system. Traditionally this functionality would only exist in the well control package as a component that is added to the tree during a well intervention, but this results in high pressure well fluids being controlled in a large diameter bore, thus making the solution impractical as pressures continue to rise, and weight being moved further up from the wellhead, thus creating larger bending moments. This concept of merging tree and well access/control functionality becomes important for tree systems above 15 k PSI. The tree facilitates the retrofit of downhole equipment in an existing tree without having to pull the tree and add electrical connections when the feedthrough is made through the tree cap. Traditionally, ESP's are deployed in horizontal subsea trees in which the electrical connectors for the ESP must be installed when the completion is run and the tubing hanger is latched in. The tree makes conventional tree weight and size less dependent on completion size by eliminating the need for large FSC barrier element actuators in the vertical production bore and providing well access through barrier elements or closure devices. The tree provides means for accommodating downhole equipment which is suspended from a downhole equipment hanger positioned in the vertical production bore or in the tubing hanger. The tree allows for the use of electric, optic and fluid connections. These connections may be wet mate, dry mate or even wireless, and they may extend through the tree cap or radially through, e.g., the tree. The tree is cost effective; it can be installed on wire without the use of a MODU and without the need to pull barrier elements, such as plugs, in the tree. The generally lateral production outlet can be formed in a number of possible locations, whereas in a horizontal tree it is typically located near the tubing hanger. Circulation lines can be fitted to the tree to facilitate circulating out of fluids trapped between closure devices, as is done with a subsea intervention system, or pressure testing between closure devices. In this way, the tree further integrates functionality that is normally provided by a well control package into the tree, thereby facilitating intervention. An intervention workover control system ("IWOCS") can be integrated between the tree and the well control package to thereby minimize the number of umbilicals in the water, thus simplifying integrated operation and allowing well control (valve actuation) operations to be conducted either (roughly) over the top of the well, as is typical, or from the host facility in the event the tree is tied back to a host through a production control umbilical or other communication to a remote location.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE INVENTION

Figure 1:
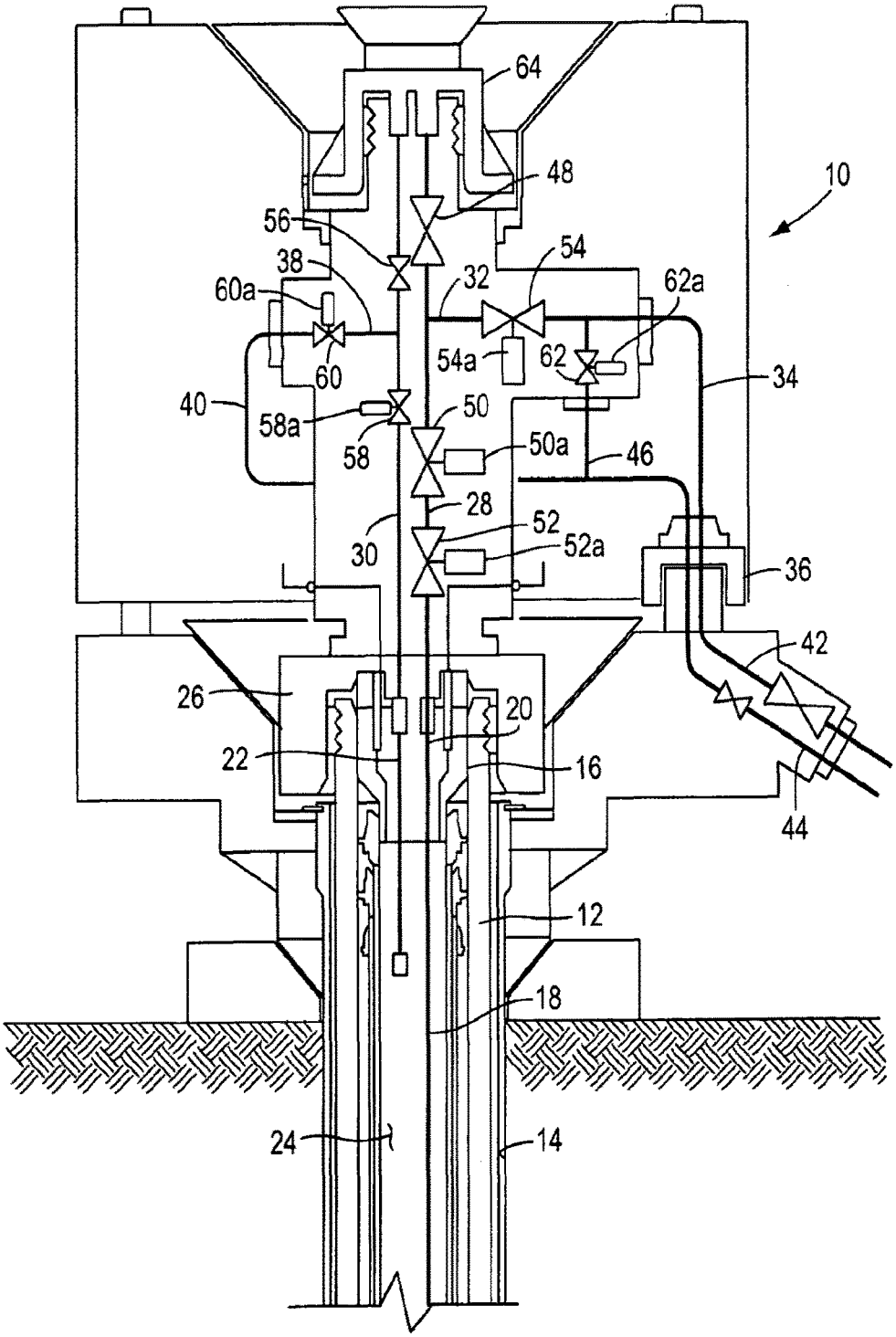
FIG. 1 (Prior Art)
FIG. 1 is a representation of an exemplary prior art vertical christmas tree.

FIG. 1 is a schematic representation of an illustrative embodiment of a prior art vertical christmas tree ("VXT"). The VXT, generally 10, comprises part of a subsea hydrocarbon production system that also includes a wellhead 12 which is positioned at the upper end of a well bore 14, a tubing hanger 16 which is landed in the wellhead, and a production tubing string 18 which extends from the tubing hanger into the well bore. The tubing hanger comprises an axially extending tubing hanger production bore 20 which is connected to the tubing string 18 and an axially extending tubing hanger annulus bore 22 which is connected to a tubing annulus 24 surrounding the tubing string.

The VXT 10 is installed on the top of the wellhead 12 and is locked thereto using a conventional hydraulic connector 26. The VXT 10 includes an axially extending production bore 28 which is connected to the tubing hanger production bore 20 and an axially extending annulus bore 30 which is connected to the tubing hanger annulus bore 22. The production bore 28 is connected to a lateral production outlet 32 which in turn is connected via a production flow loop 34 to a flowline connector 36. Similarly, the annulus bore 30 is connected to a lateral annulus outlet 38 which in turn is connected via an annulus flow loop 40 to the flowline connector 36. The flowline connector 36 connects the production flow loop 34 to a production flowline 42 and the annulus flow loop 40 to an annulus flowline 44. The production flowline 42 and the annulus flowline 44 may in turn be connected to, e.g., a conventional bridge module or manifold module (not shown). Also, the production outlet 32 and the annulus flow loop 40 may be connected via a crossover line 46.

The VXT 10 comprises a number of valves for controlling the flow of fluids through the hydrocarbon production system. In the embodiment shown in FIG. 1, for example, a production swab valve ("PSV") 48 is located in the production bore 28 above the production outlet 32, an upper production master valve ("UPMV") 50 is located in the production bore below the production outlet, a lower production master valve ("LPMV") 52 is located in the production bore below the UPMV, and a production wing valve ("PWV") 54 is located in the production outlet between the production bore and the production flow loop 34. In addition, an annulus swab valve ("ASV") 56 is located in the annulus bore 30 above the annulus outlet 38, an annulus master valve ("AMV") 58 is located in the annulus bore below the annulus outlet, an annulus wing valve ("AWV") 60 is located in the annulus outlet between the annulus bore and the annulus flow loop 40, and a crossover valve ("XOV") 62 is located in the crossover line 46 between the production outlet and the annulus flow loop.

In the conventional VXT 10 shown in FIG. 1, the UPMV 50, the LPMV 52 and the PWV 54 comprise respective actuators 50*a*, 52*a* and 54*a*, such as hydraulic or electric actuators which are designed to fail closed in the event of a loss of hydraulic or electric power. Likewise, the AMV 58, the AWV 60 and the XOV 62 comprise respective actuators 58*a*, 60*a* and 62*a* which are also designed to fail closed in the event of an emergency or a loss of hydraulic or electric power. The PSV 48 and ASV 56, on the other hand, are depicted as manually operated valves which are normally actuated by a remotely operated vehicle ("ROV"), although they could be fail-safe-closed ("FSC") valves which are controlled by a workover control system ("WOCS").

During the production mode of operation of the VXT 10, the UPMV 50, LPMV 52 and MAN 54 are opened and the PSV 48 and XOV 62 are closed. In this configuration, the produced fluid will be directed from the production bore 28 into the production outlet 32 and from there into the production flow loop 34 and the production flow line 42. In addition to the PSV 48, a tree cap 64, crown plug, or similar device is locked and sealed to the top of the VXT 10 to provide a second pressure barrier between the production bore 28 and the environment. The UPMV 50 and the LPMV 52 typically remain open except in the event of an emergency, when the well is shut down, or when needed to provide a pressure barrier between the well bore and the environment, such as when the tree cap 64 is removed in preparation for the installation of intervention equipment.

Figure 2:
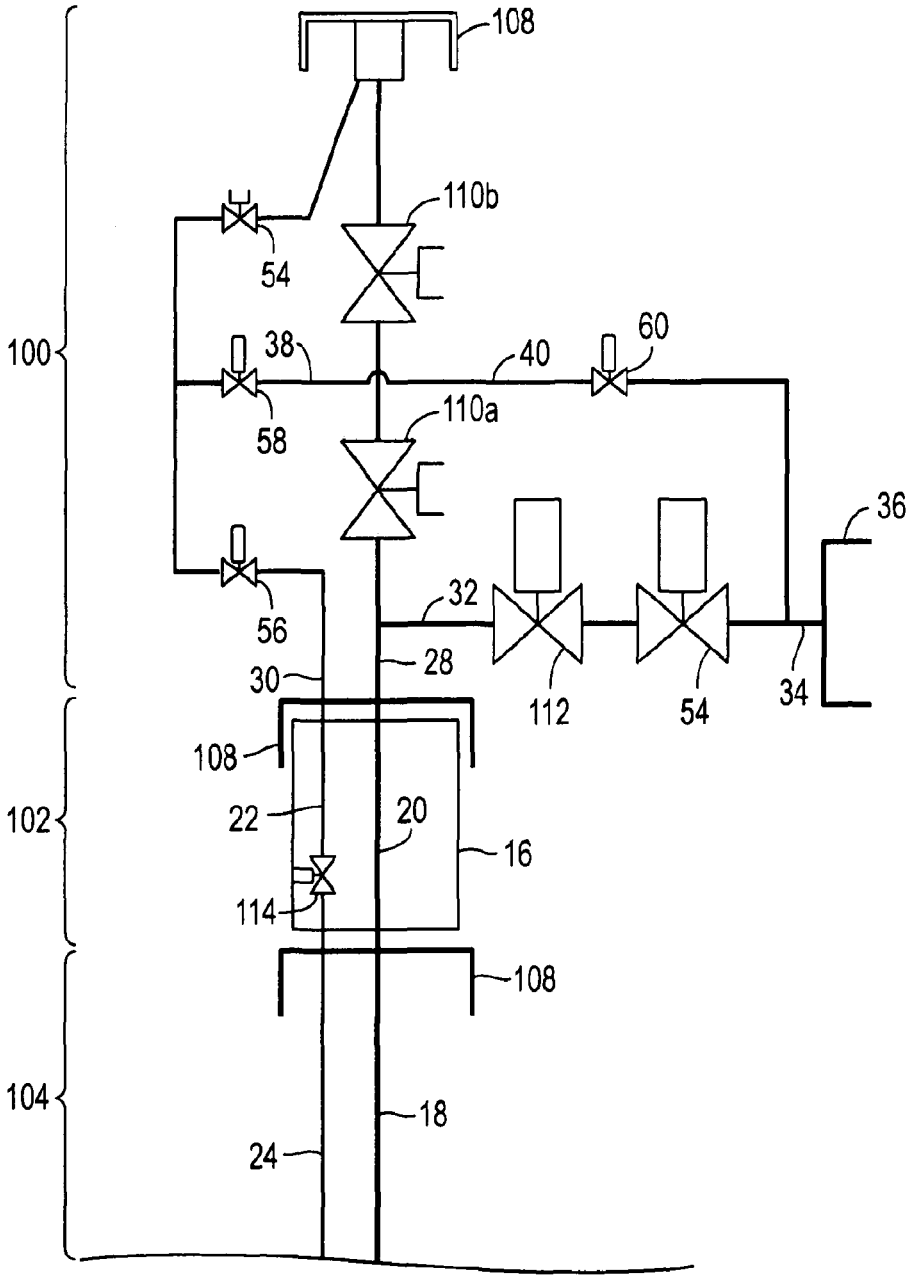
FIG. 2 is a schematic representation of a first embodiment of the christmas tree of the present invention.

A first embodiment of the christmas tree of the present invention is shown schematically in FIG. 2. The christmas tree of this embodiment, generally 100, is shown mounted on a tubing head 102 which in turn is mounted on a wellhead 104. A tubing hanger 16 from which a production tubing string 18 is suspended is landed in the tubing head 102. The tubing hanger 16 comprises an axially extending tubing hanger production bore 20 which is connected to the tubing string 18 and an axially extending tubing hanger annulus bore 22 which is connected to the tubing annulus 24 surrounding the tubing string. The top and bottom ends of each of the tree 100 and the tubing head 102, as well as the top end of the wellhead 104, are ideally provided with a common connection profile 108, such as an H4 profile, to facilitate the use of these components in a variety of subsea production system configurations. In the embodiment shown in FIG. 2, for example, the tubing head 102 may be omitted and the tree 100 instead mounted directly on the wellhead 104, which in this embodiment would be designed to receive the tubing hanger 16.

Similar to the VXT 10 described above, the tree 100 includes an axially extending production bore 28 which is connected to the tubing hanger production bore 20, an axially extending annulus bore 30 which is connected to the tubing hanger annulus bore 22, at least one production outlet 32 which is connected to the production bore, and a laterally extending annulus outlet 38 which is connected to the annulus bore. The production outlet 32 is connected via a production flow loop 34 to a flowline connector 36. Similarly, the annulus outlet 38 is connected via an annulus flow loop 40 to the flowline connector 36. The flowline connector 36 in turn connects the production and annulus flow loops 34, 40 to respective production and annulus flowlines (not shown).

The tree 100 includes a number of barrier elements and closure devices for controlling the flow of fluids through the hydrocarbon production system. As used herein, a "barrier element" is an active actuated FSC valve, that is, a FSC valve, such as a PMV or a PWV, which is not locked in the open position. Also, a "closure device" is a non-active actuated FSC valve (i.e., an FSC valve which is locked in the open position), an actuated fail-as-is ("FAI") valve, an actuated fail-safe-open ("FSO") valve, a manual valve, plug, tree cap, coiled tubing stripper, pipe ram, or any other such device which functions to hold pressure when closed. Examples of valve-type closure devices include swab valves, service valves, isolation valves, master valves and safety valves.

In contrast to the VXT 10 described above, the tree 100 does not include any barrier elements in the production bore 28. Instead, at least one and preferably two closure devices are provided in the production bore 28 and the barrier elements are moved to the production outlet 32. In the embodiment of the invention shown in FIG. 2, for example, a lower production swab valve ("LPSV") 110*a* and an upper production swab valve ("UPSV") 110*b* are provided in the production bore 28 above the production outlet 32 and an active actuated PMV 112 is provided in the production outlet 32 between the production bore and the PWV 54 (similar to a conventional horizontal tree). In the production mode of operation of the tree 100, both the LPSV 110*a* and the UPSV 110*b* may be closed to provide the necessary pressure barriers between the production bore 28 and the environment without the need for a pressure-containing tree cap or similar device.

Compared to the VXT 10, the tree 100 in effect moves the barrier elements and their associated actuators from the production bore 28 to the production outlet 32. As a result, the size of the production bore 28 is not constrained by the size of the valve actuators, at least where the closure devices in the production bore do not comprise actuated valves. Consequently, the diameter of the production bore 28 can be increased independently without an associated increase in the size and weight of the tree, which would otherwise be required to accommodate the larger valve actuators. At the same time, the diameter of the production outlet 32, and thus the size of the actuators for the production outlet valves, can remain relatively small. In one embodiment of the tree 100, for example, the production bore 28 may comprise an inner diameter of 7 inches or larger while the production outlet may comprise an inner diameter of 5 inches. This relatively large production bore 28 can accommodate larger intervention tools as well as any submersible device that may be suspended and retrievable through the production bore. In addition, since the LPSV 110*a* and UPSV 110*b* are not active actuated FSC valves, no risk exists that either the valves, the intervention tool string, or a power cable, for example, will be damaged in the event of inadvertent operation or a loss of hydraulic or electric power to the tree 100.

In addition to the production valves just described, the tree 100 comprises a number of valves for controlling or monitoring pressure in the annulus bore 30. As shown in FIG. 2, a manually operated ASV 54 is provided in the annulus bore 30 above the annulus outlet 38, an actuated AMV 56 is provide in the annulus bore below the annulus outlet, an actuated AWV 58 is provided in the annulus outlet between the annulus bore and the annulus flow loop 40, and an actuated XOV 60 is provided in the annulus flow loop between the annulus outlet and the production flow loop 34. In addition, an annulus access valve ("AAV") 114 may be provided in the tubing hanger annulus bore 22.

Figure 3:
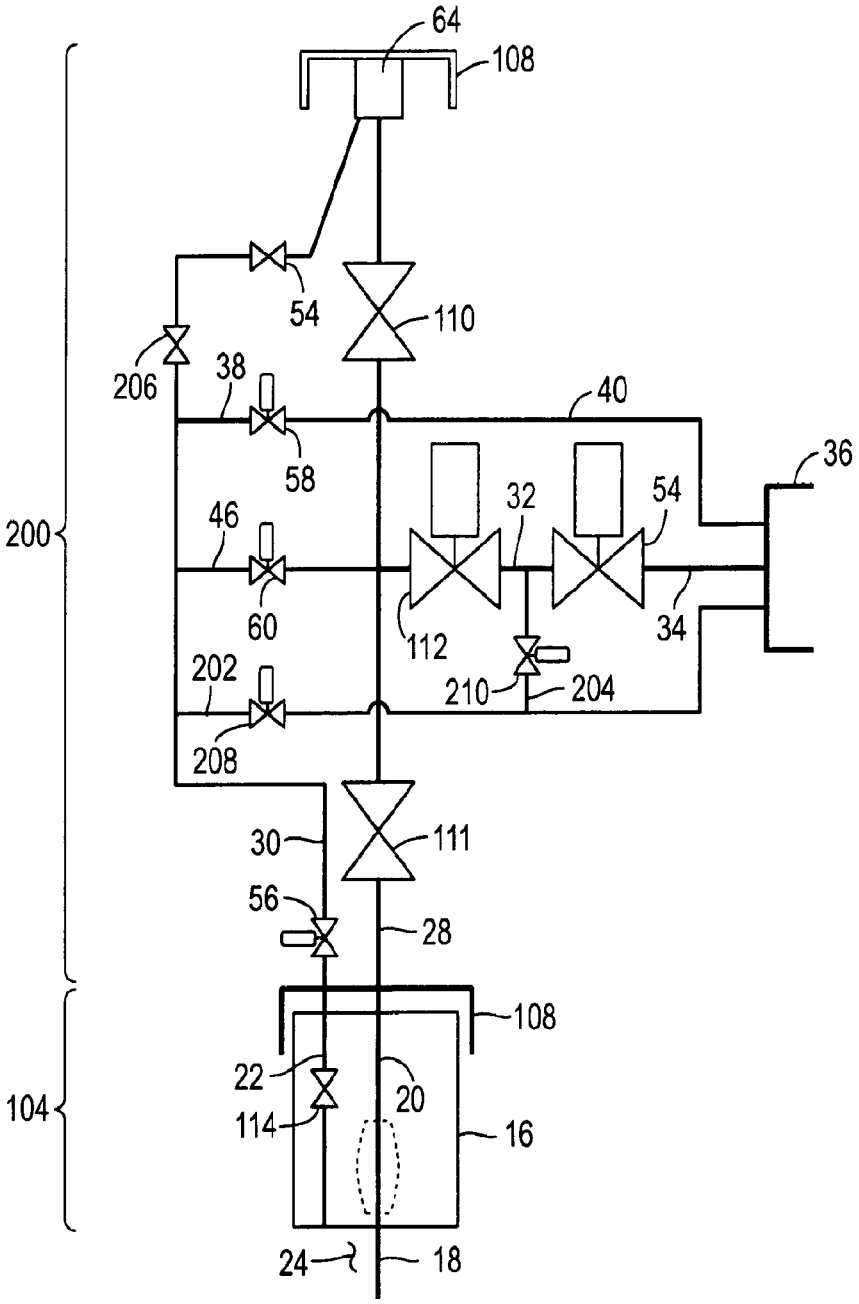
FIG. 3 is a schematic representation of a second embodiment of the christmas tree of the present invention.

A second embodiment of the christmas tree of the present invention is shown schematically in FIG. 3. The christmas tree of this embodiment, generally 200, is shown mounted on a wellhead 104 which is positioned at the upper end of a well bore. A tubing hanger 16 from which a production tubing string 18 is suspended is landed in the wellhead 104. The tubing hanger 16 comprises an axially extending tubing hanger production bore 20 which is connected to the tubing string 18 and an axially extending tubing hanger annulus bore 22 which is connected to the tubing annulus 24 surrounding the tubing string.

The tree 200 includes an axially extending production bore 28 which is connected to the tubing hanger production bore 20, an axially extending annulus bore 30 which is connected to the tubing hanger annulus bore 22, at least one production outlet 32 which is connected to the production bore, and a laterally extending annulus outlet 38 which is connected to the annulus bore. The production outlet 32 is connected via a production flow loop 34 to a flowline connector 36. Similarly, the annulus outlet 38 is connected via an annulus flow loop 40 to the flowline connector 36. The tree 200 also includes a crossover line 46 which connects the annulus bore 30 to the production bore 28, an annulus bypass line 202 which connects the annulus bore directly to the flowline connector 36 and a monitor line 204 which connects the annulus bypass line to the production outlet 32.

Similar to the tree 100 described above, the tree 200 replaces the barrier elements in the production bore 28 with closure devices. A PSV 110 is provided in the production bore 28 above the production outlet 32 and a production isolation valve ("PIV") 111 is provided in the production bore below the production outlet. The PIV 111 may be any of the closure devices described above, such as a manual valve or a FAI, FSO or locked-open FSC actuated valve. Also, a barrier element, in this case an active actuated PMV 112, is provided in the production outlet 32 between the production bore 28 and the PWV 54. During the production mode of operation, the PSV 110 is closed and a pressure-containing tree cap 64 or similar device is connected to the top of the tree 200 to provide two pressure barriers between the production bore 28 and the environment.

As with the tree 100, the lack of any barrier elements in the production bore 28 will allow the diameter of the production bore to be increased without an associated increase in the size and weight of the tree 200 due to the requirement for larger valve actuators. In addition, no risk exists that either the PSV 110, the PIV 111, an intervention tool string, or a power cable, for example, will be damaged in the event of inadvertent operation or a loss of hydraulic or electric power to the tree 200.

The tree 200 also includes a manually operated ASV 54 in the annulus bore 30 above the annulus outlet 38, an actuated AMV 56 in the annulus bore below the annulus outlet, an actuated AWV 58 in the annulus outlet between the annulus bore and the annulus flow loop 40, and an actuated XOV 60 in the crossover line 46 between the annulus line and the production bore 28. The tree 200 may further include a manually operated annulus isolation valve ("AIV") 206 in the annulus bore between the ASV 54 and the annulus outlet 38, an actuated annulus bypass valve ("ABV") 208 in the annulus bypass line 202 between the annulus bore and the monitor line 204, and an actuated monitor isolation valve ("MIV") 210 in the monitor line between the production outlet 32 and the annulus bypass line.

Figure 4:
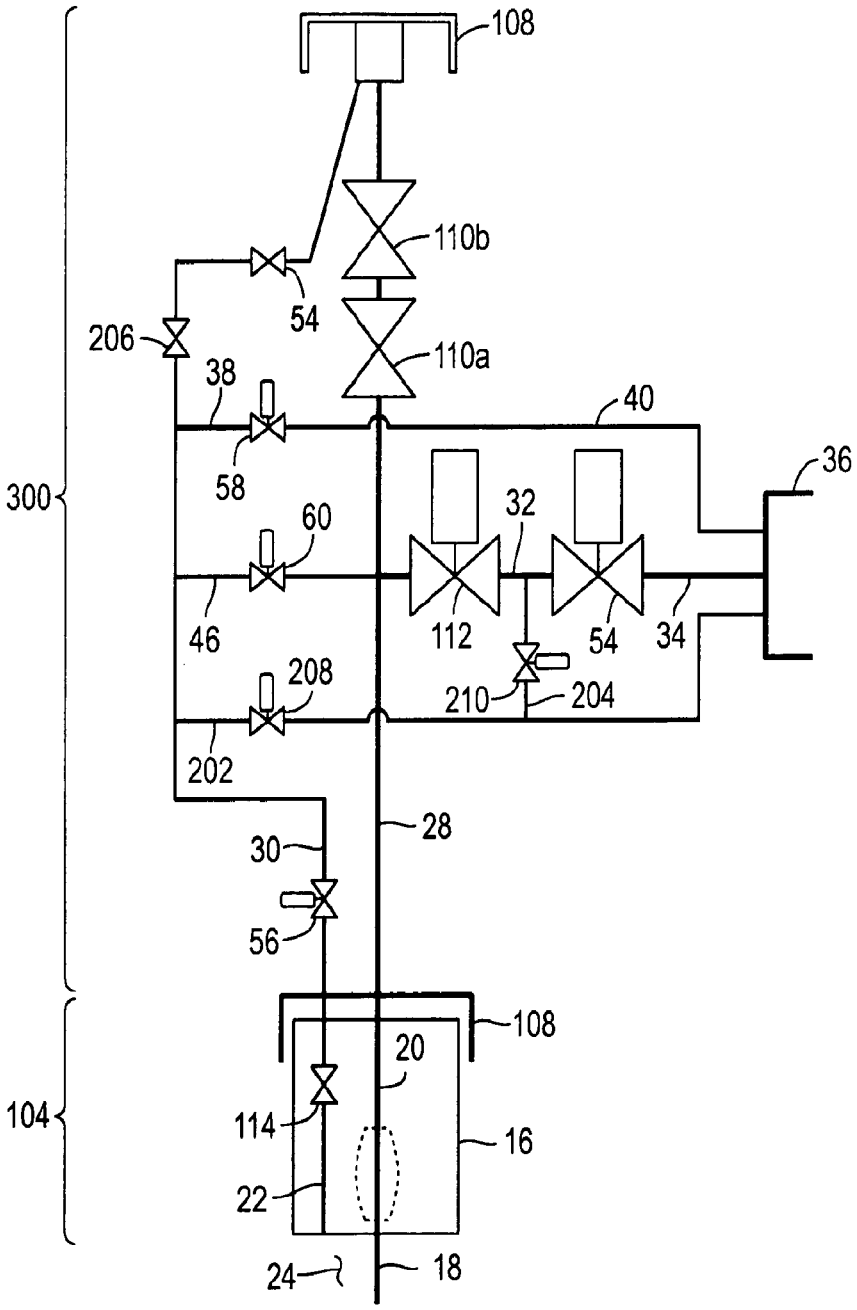
FIG. 4 is a schematic representation of a third embodiment of the christmas tree of the present invention.

A third embodiment of the christmas tree of the present invention is shown in FIG. 4. The christmas tree of this embodiment, generally 300, is similar in many respects to the tree 200 described above. In the present embodiment, however, the PIV 111 is omitted and instead an LPSV 110*a* and UPSV 110*b* are positioned in the production bore 28 above the production outlet 32. As a result, the LPSV 110*a* and UPSV 110*b* are capable of providing double barrier protection between the production bore 28 and the environment without the need for a pressure-containing tree cap or similar device.

Figure 5:
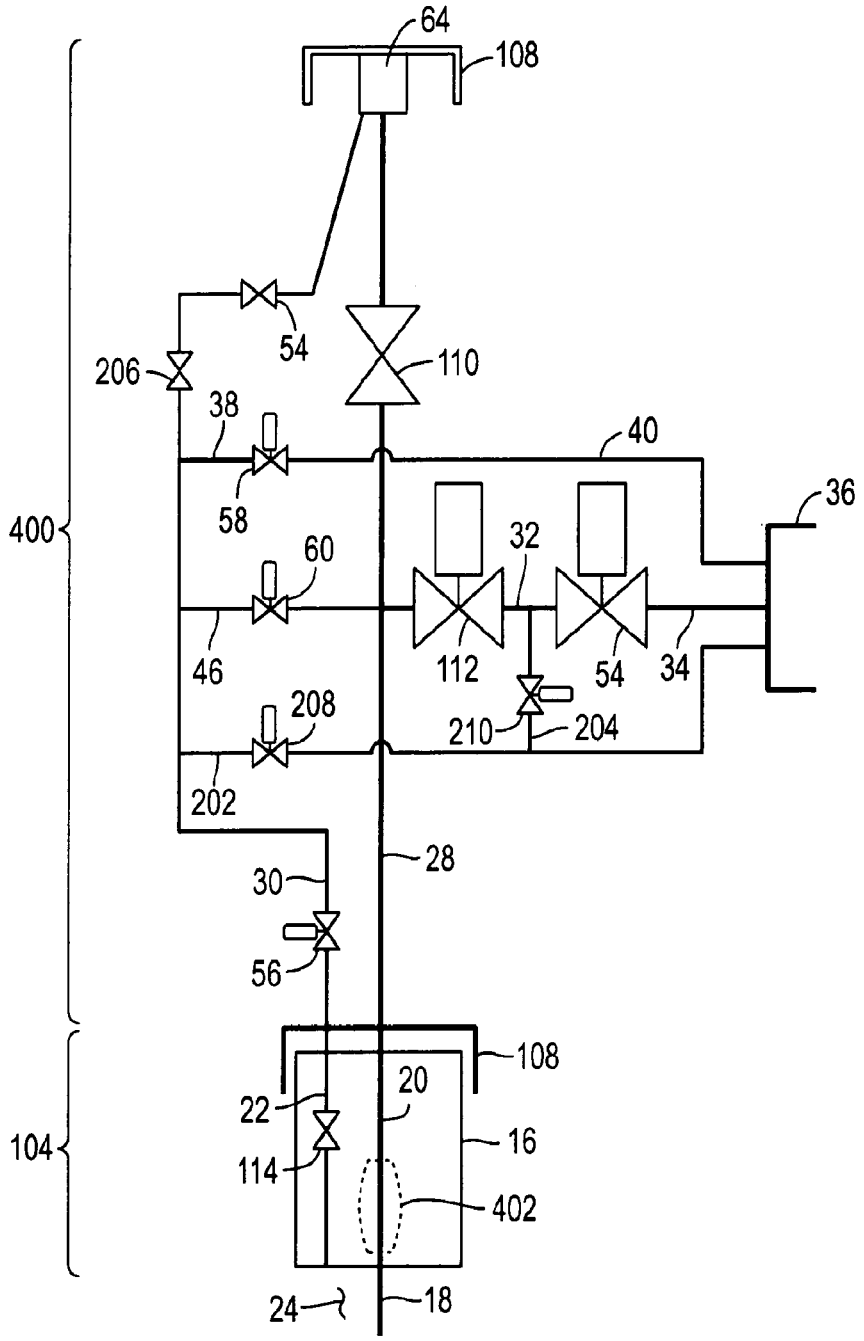
FIG. 5 is a schematic representation of a fourth embodiment of the christmas tree of the present invention.

A fourth embodiment of the christmas tree of the present invention is shown in FIG. 5. The christmas tree of this embodiment, generally 400, is similar in most respects to the tree 300 described above. In the present embodiment, however, double barrier protection between the production bore 28 and the environment is provided by a single PSV 110 and a pressure-containing tree cap 64. Also, a conventional plug profile 402 may be provided in the tubing hanger production bore 20 in the event a wireline plug is required to be installed in the tubing hanger 16 as a further means for isolating the production bore from the environment.

Figure 6:
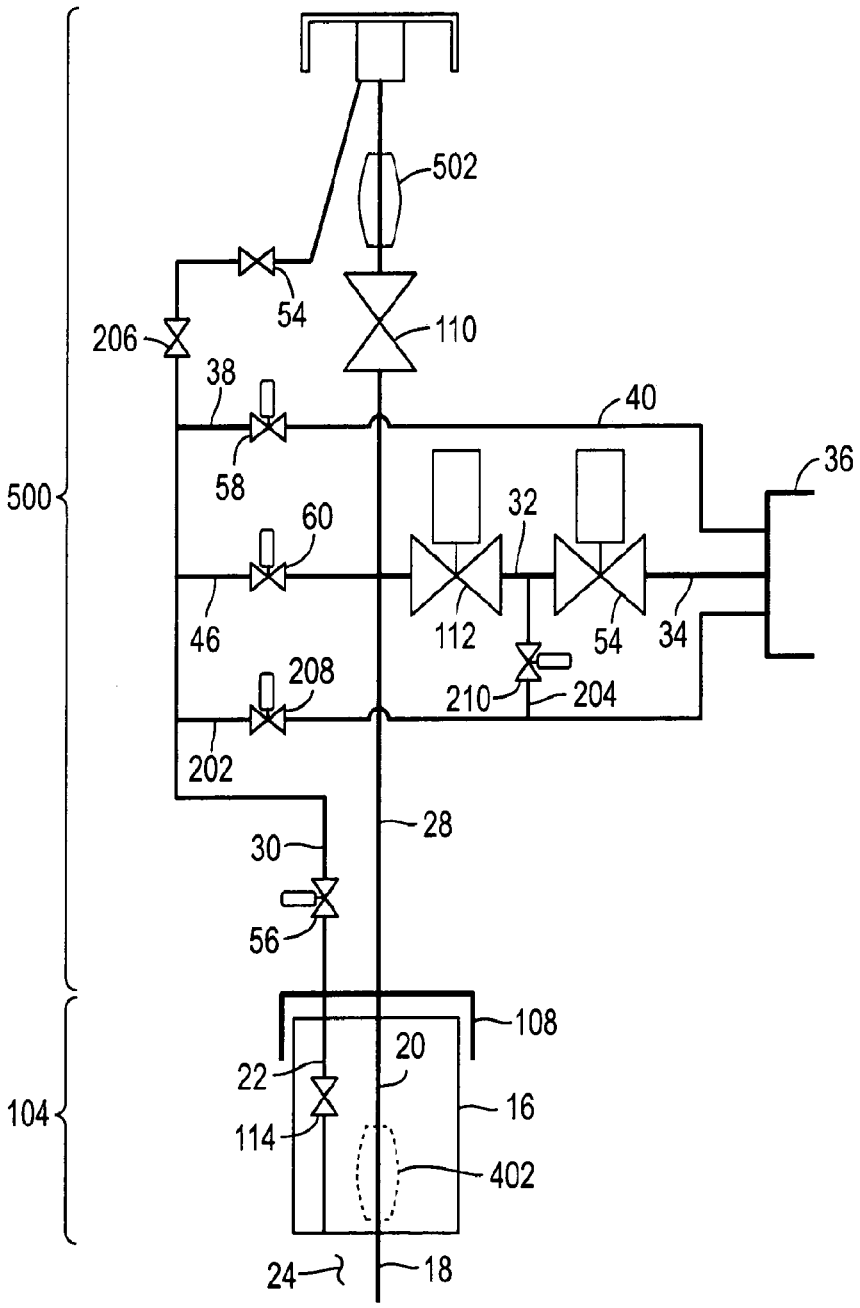
FIG. 6 is a schematic representation of a fifth embodiment of the christmas tree of the present invention.

A fifth embodiment of the christmas tree of the present invention is shown in FIG. 6. The christmas tree of this embodiment, generally 500, is similar in most respects to the tree 400 described above. In the present embodiment, however, double barrier protection between the production bore 28 and the environment is provided by the PSV 110 and a conventional wireline plug 502, which is installed in the production bore above the PSV.

Figure 7:
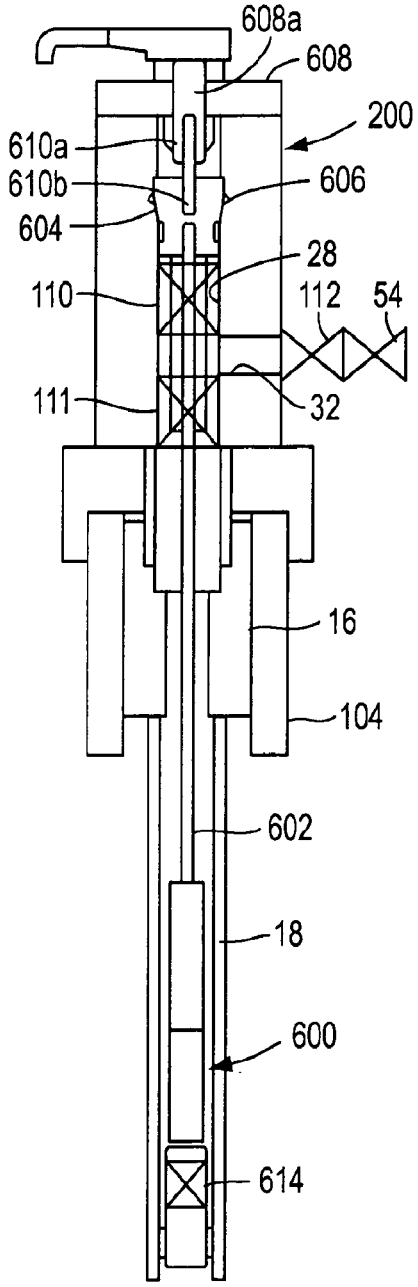
FIG. 7 is a representation of the tree of FIG. 3 shown with a first embodiment of the ESP power feedthrough arrangement of the present invention.
Figure 8:
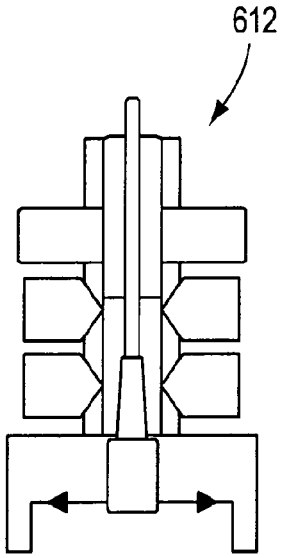
FIG. 8 is a representation of a WCP interface which is configured for use with the tree of FIG. 7.
Figure 9:
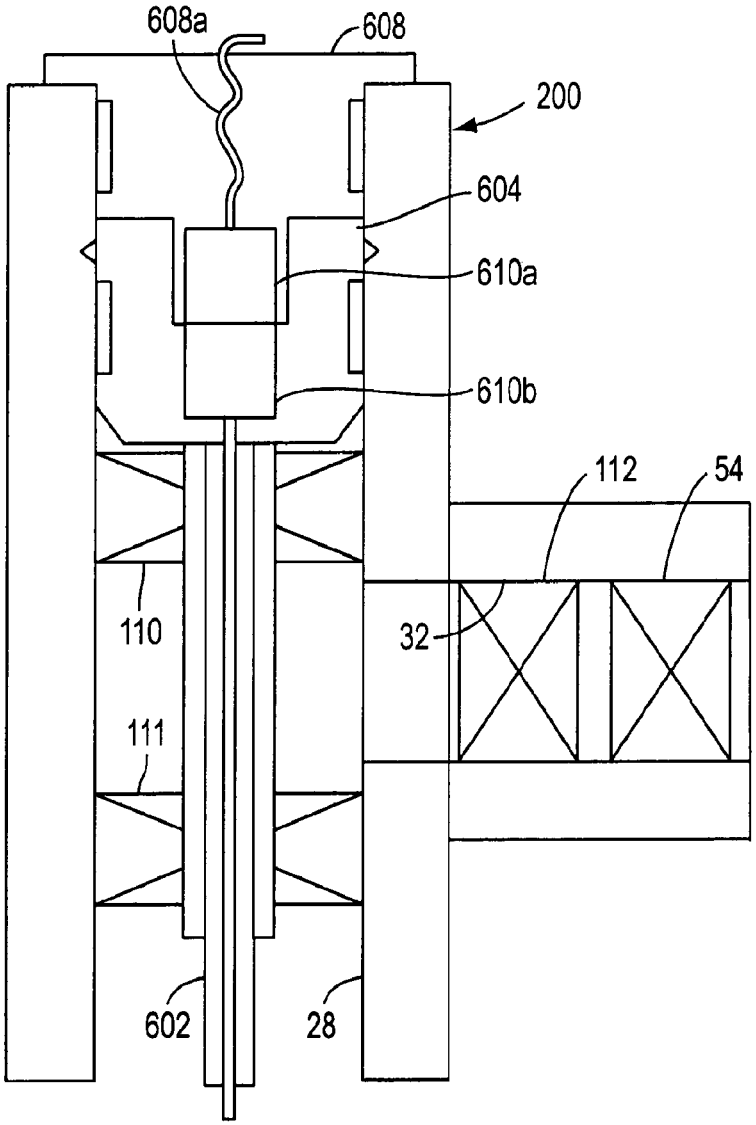
FIG. 9 is an enlarged view of the tree of FIG. 7.

As discussed above, by eliminating the barrier elements in the production bore, the christmas tree of the present invention facilitates the use of downhole equipment devices, such as submersible pumps, in subsea hydrocarbon production systems. Referring to FIGS. 7-9, for example, the christmas tree 200 discussed above is shown with a submersible pump 600, such as an ESP, which is positioned in the production tubing 18. The ESP 600 is suspended from a suspension string 602 which extends from a downhole equipment hanger 604. The suspension string 602 may be, for example, an electric cable, a hydraulic hose, or a coiled tubing or drill pipe through which a number of electric cables and/or hydraulic hoses extend. In the case of the ESP 600, for example, the suspension string may comprise an electric cable. The downhole equipment hanger 604 is locked and sealed in, e.g., a wireline plug profile 606 in the production bore 28 above the PSV 110. Thus, the suspension string 602 extends through both the open PSV 110 and PIV 111. A tree cap 608 is secured to the top of the tree 200 above the downhole equipment hanger 604. The tree cap 608 may be a pressure containing- or debris-type cap, and may be ROV installable. In addition, the tree cap 608 may comprise a power and/or ("PU") feedthrough 608*a* which is configured to provide a path through the tree cap for such attributes as power (e.g., electrical and/or hydraulic), control (e.g., power and signals), communication (e.g., electric or fiber optic), or fluid (e.g., lubrication, chemicals, hydraulic, actuation, and/or testing). As shown in FIG. 9, for example, power for the ESP 600 is routed through the PU feedthrough 608*a* in the tree cap 608 and transmitted to the suspension string 602 via a wet mate connector half 610*a* in the tree cap which engages a corresponding wet mate connector half 610*b* in the downhole equipment hanger 604.

During the production mode of operation of the tree 200, the downhole equipment hanger 604 and the tree cap 608 provide two pressure barriers between the well bore and the environment. In the event the ESP 600 should need to be replaced, the tree cap 608 can be removed and a well control package ("WCP") 612 (FIG. 8) connected to the top of the tree 200. The WCP 612 may be extended to the surface with a riser (not shown). Alternatively, a riserless light well intervention ("RLWI") unit (not shown) may be connected to the top of the tree 200 to perform functions of WCP. During this operation, a downhole valve 614 (FIG. 7) and additional barrier elements/closure devices (not shown) located in the production tubing 18 below the ESP 600 provide a second pressure barrier between the well bore and the environment. After the WCP 612 with a riser or a RLWI is connected to the tree 200, the ESP 600 can be retrieved and a new ESP installed. The WCP 612 with riser or RLWI is then removed and the tree cap 608 reinstalled to establish power to the new ESP 600.

Figure 10:
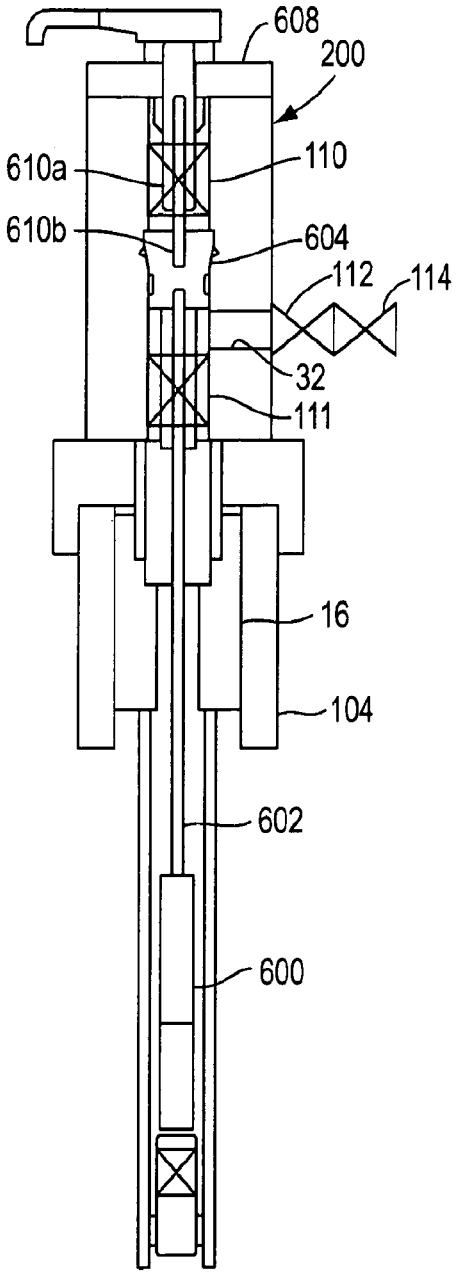
FIG. 10 is a representation of the tree of FIG. 3 shown with a second embodiment of the ESP power feedthrough arrangement of the present invention.
Figure 11:
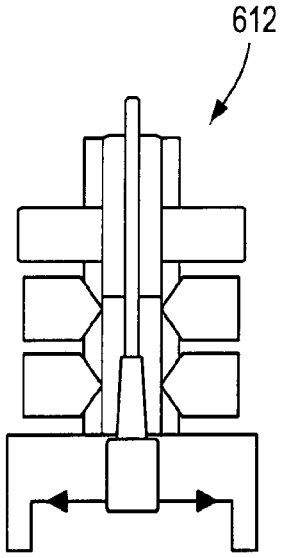
FIG. 11 is a representation of a WCP interface which is configured for use with the tree of FIG. 10.
Figure 12:
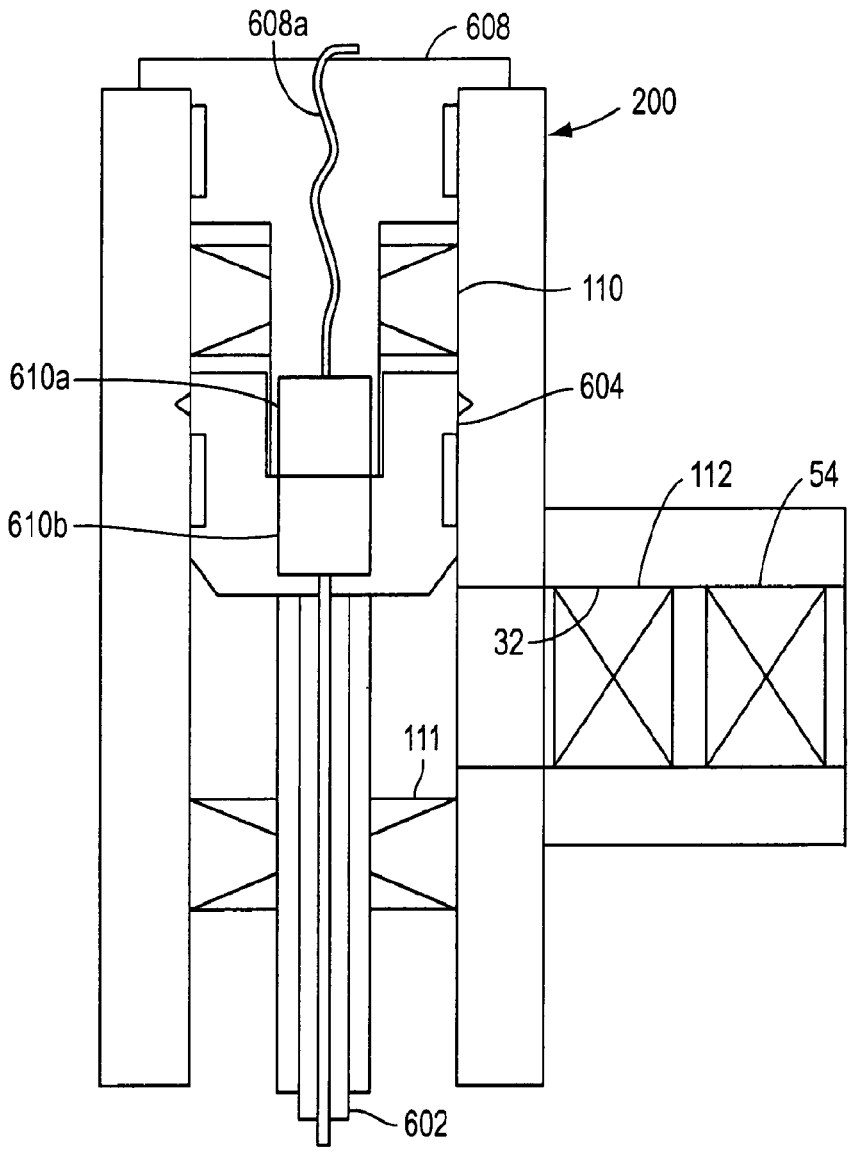
FIG. 12 is an enlarged view of the tree of FIG. 10.

An alternative arrangement for deploying downhole equipment such as the ESP 600 in the tree 200 is shown in FIGS. 10-12. In this embodiment, the downhole equipment hanger 604 is locked and sealed in the production bore 28 below the PSV 110 and above the production outlet 32, and the wet mate connector half 610*a* is configured to extend through the PSV to the equipment hanger. This arrangement allows the PSV 110 to be used as a second pressure barrier between the well bore and the environment when the tree cap 608 is removed for intervention operations.

Figure 13:
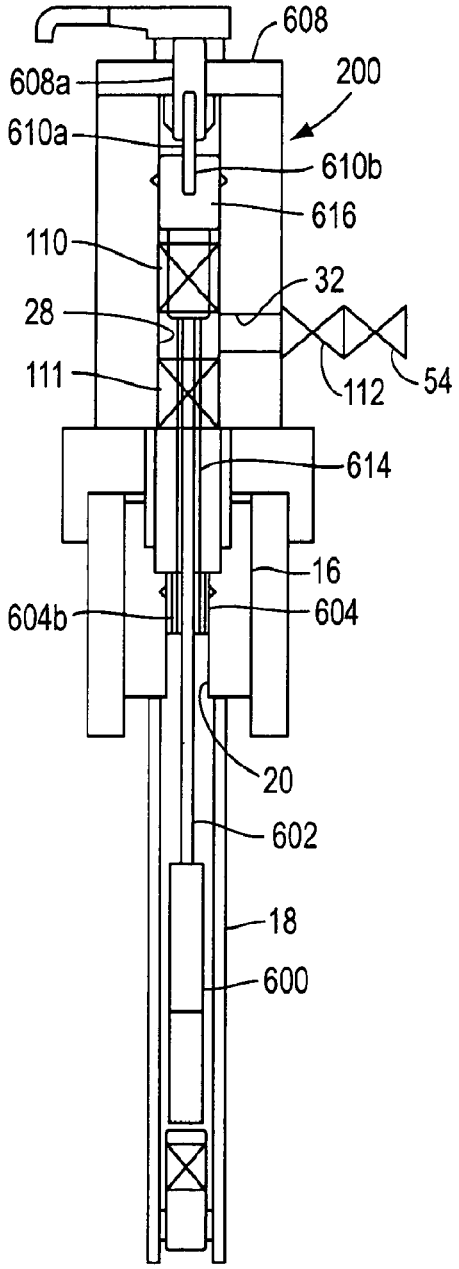
FIG. 13 is a representation of the tree of FIG. 3 shown with a third embodiment of the ESP power feedthrough arrangement of the present invention.
Figure 14:
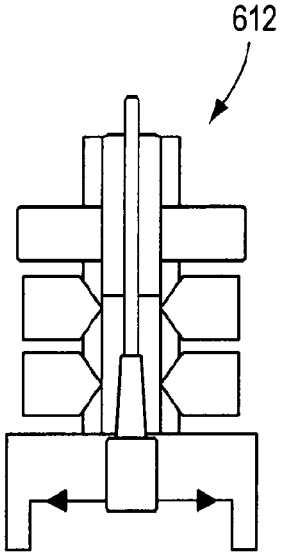
FIG. 14 is a representation of a WCP interface which is configured for use with the tree of FIG. 13.

Another alternative arrangement for deploying downhole equipment such as the ESP 600 in the tree 200 is shown in FIGS. 13-14. In this embodiment, the suspension string 602 is suspended from a flow-through downhole equipment hanger 604*a* which is landed and locked in the tubing hanger production bore 20. The downhole equipment hanger 604*a* comprises a number of axial throughbores 604*b* to permit fluid communication between the tubing hanger production bore 20 and the tree production bore 28. A suspension string extender 614, similar in construction to the suspension string 602, is used to connect the suspension string to a wet mate connector half 610*b* located in a termination head 616 which is sealed and optionally locked to the production bore 28 above the PSV 110. The wet mate connector half 610*b* is in turn connected to a corresponding wet mate connector half 610*a* in the tree cap 608. The tree cap 608*a* includes a PU feedthrough 608*a* and may also comprise a mechanism (not shown) for extending the wet mate connector half 610*a* into mating engagement with the wet mate connector half 610*b*.

Figure 15:
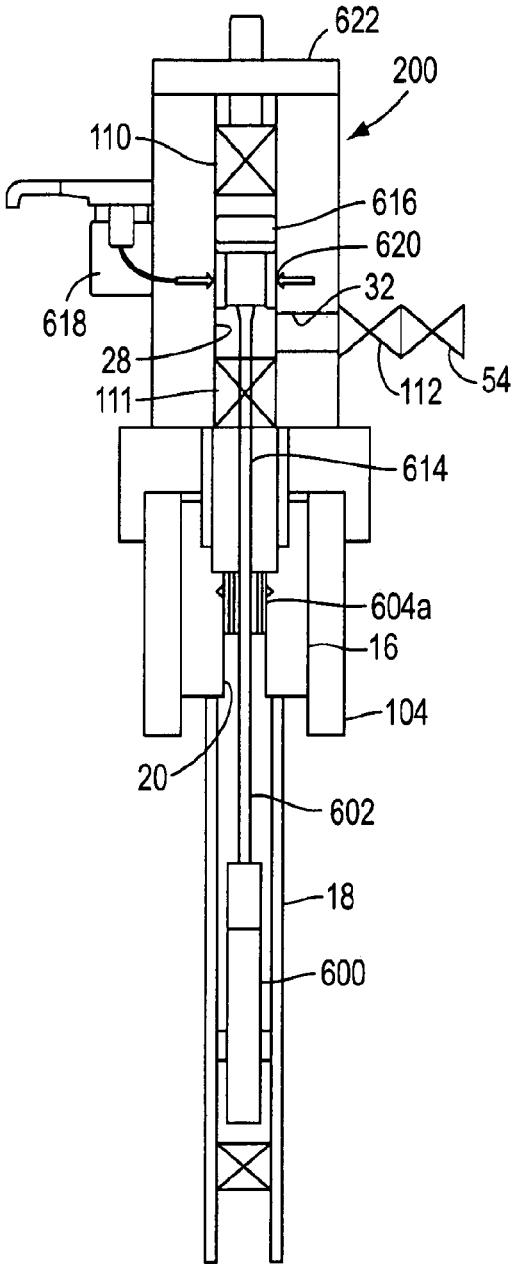
FIG. 15 is a representation of the tree of FIG. 3 shown with a fourth embodiment of the ESP power feedthrough arrangement of the present invention.
Figure 16:
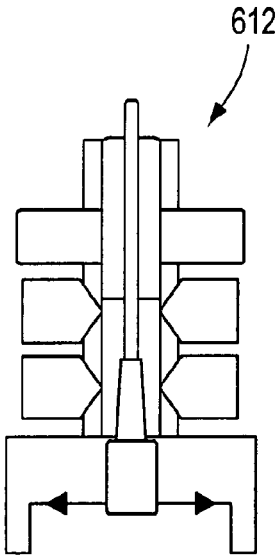
FIG. 16 is a representation of a WCP interface which is configured for use with the tree of FIG. 15.

A further alternative arrangement for deploying downhole equipment such as the ESP 600 in the tree 200 is shown in FIGS. 15-16. In this embodiment, power for the ESP 600 is supplied via one or more radial wet mate connector halves 618. The wet mate connector halves 618 comprises one or more connection elements which engage with corresponding wet mate connector halves 620 located in a termination head 616 which is positioned in the production bore 28 above the production outlet 32 and below the PSV 110. The wet mate connector halves 620 are in turn connected via a suspension string extender 614 to the suspension string 602 extending from the flow-through downhole equipment hanger 604*a*. This arrangement allows the PSV 110 to act as a pressure-containing barrier between the well bore and the environment during the production mode of operation of the tree 200. The second pressure-containing barrier is provided by a tree cap 622 which is locked and sealed to the top of the tree 200.

Figure 17:
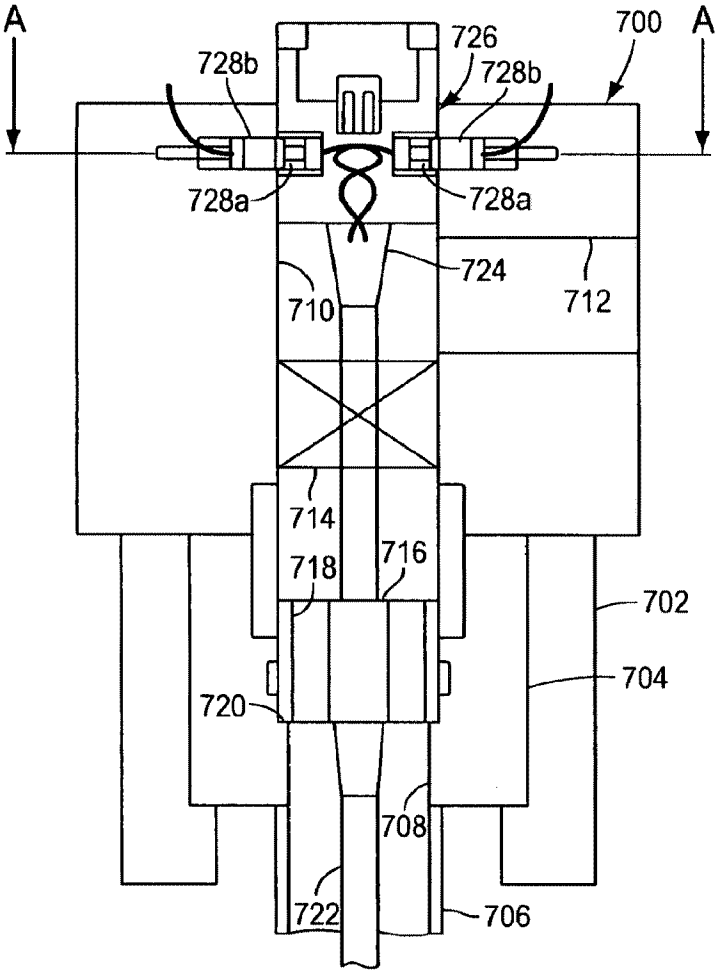
FIG. 17 is a representation of a christmas tree shown with yet another embodiment of the ESP power feedthrough arrangement of the present invention.

Alternative arrangements for supplying power to downhole equipment such as the ESP 600 will be now described with reference to FIGS. 17-22. Referring first to FIG. 17, an illustrative VXT, generally 700, is shown installed on a wellhead 702 in which a tubing hanger 704 is landed. A production tubing string 706 is suspended from the tubing hanger 704 and extends into the well bore. The tubing hanger 704 includes a tubing hanger production bore 708 which is connected to the production tubing 706. The VXT 700 includes a vertical production bore 710 which is connected to the tubing hanger production bore 708 and a production outlet 712 which extends laterally from the production bore. As shown, a closure device, such as a manually operated PIV 714, may be provided in the production bore 710 below the production outlet 712.

Figure 18:
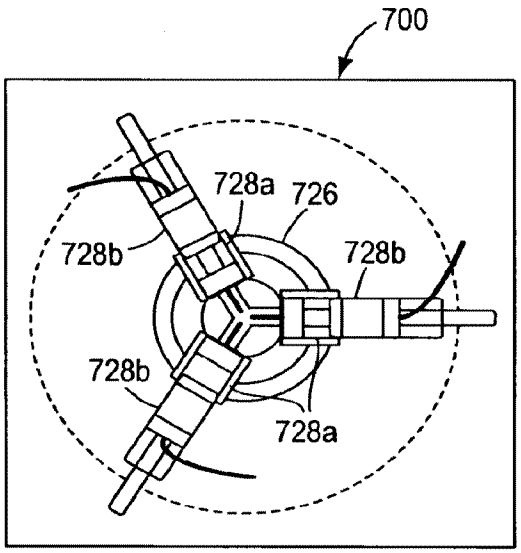
FIG. 18 is a cross sectional representation of the tree of FIG. 17 taken along line A-A.

In the power supply arrangement shown in FIGS. 17-18, a flow-through downhole equipment hanger 716 comprising a number of axial through bores 718 is landed on a hang-off shoulder 720 in the tubing hanger 704 and is locked and sealed to the tubing hanger production bore 708. The downhole equipment hanger 716 supports a suspension string 722 from which, e.g., an ESP (not shown) is suspended. A suspension string extender 724 extends up through the open PIV 714 and the production bore 710 and connects the cable 722 to a termination head 726 located in the production bore above the production outlet 712. As shown in FIG. 18, the termination head 726 comprises three single-pin wet mate connector halves 728*a* which are configured to be engaged by three corresponding single-pin wet mate connector halves 728*b* in the VXT 700. Since the downhole equipment hanger 716 is locked and sealed to the tubing hanger 704, this arrangement permits the VXT 700 to be retrieved without having to retrieve the ESP. It should be understood that the suspension string 722, the suspension string extender 724, the termination head 726 and the wet mate connector halves 728*a*, 728*b* could provide for fiber optic or hydraulic communication as an alternative or in addition to power communication, and that the wet mate connector halves are only one example of several known means for connecting one or more external cables to the termination head 726.

Figure 20:
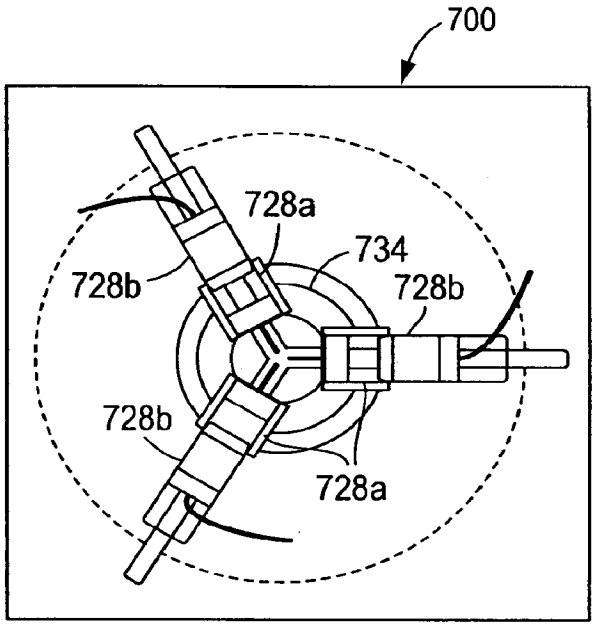
FIG. 20 is a cross sectional representation of the tree of FIG. 19 taken along line A-A.
Figure 19:
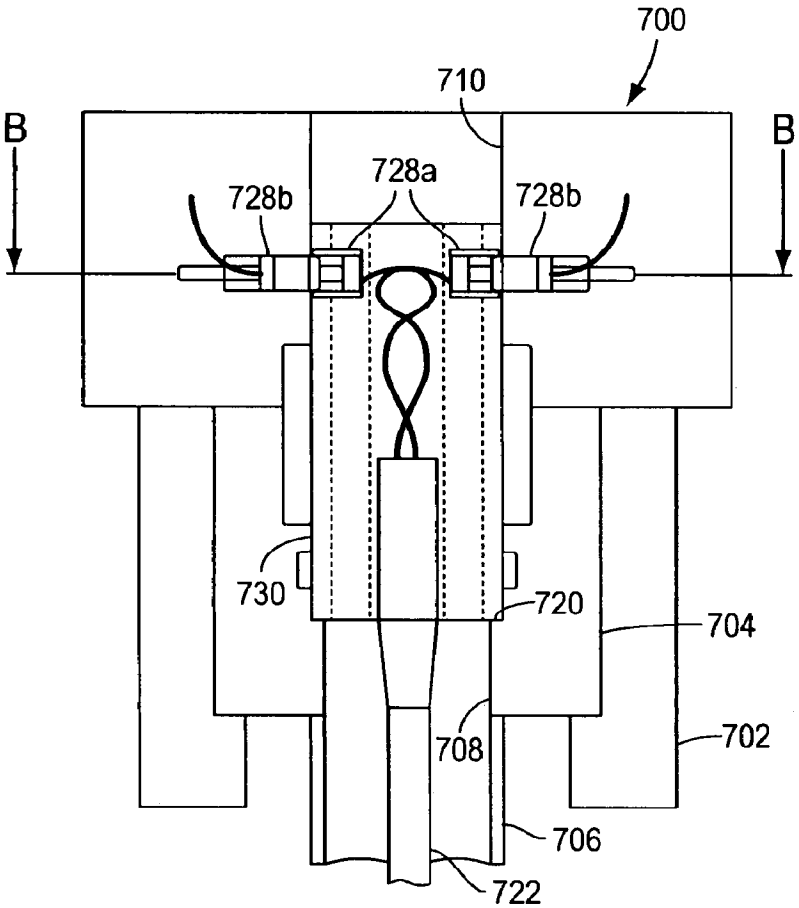
FIG. 19 is a representation of a christmas tree shown with a further embodiment of the ESP power feedthrough arrangement of the present invention.

Another downhole equipment power supply arrangement is shown in FIGS. 19-20. In this embodiment, the suspension string 722 is suspended from a downhole equipment hanger 730 which is landed on a hang-off shoulder 720 in the tubing hanger 704 and is locked and sealed to the tubing hanger production bore 708. The downhole equipment hanger 730 extends vertically into the production bore 710 below the production outlet (not shown) and comprises three single-pin wet mate connector halves 728*a* which are configured to be engaged by three corresponding single-pin wet mate connector halves 728*b* in the VXT 700. As in the previous embodiment, since the downhole equipment hanger 730 is locked and sealed to the tubing hanger 704, the VXT 700 may be retrieved without having to retrieve the downhole equipment.

Figure 22:
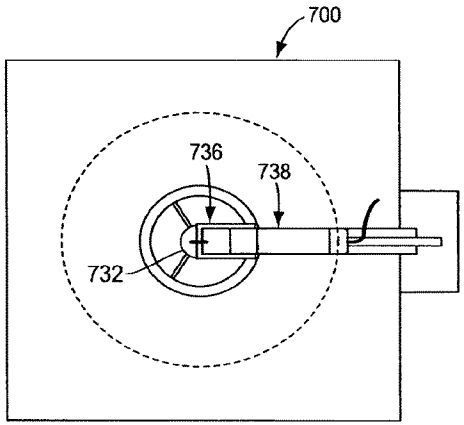
FIG. 22 is a cross sectional representation of the tree of FIG. 21 taken along line A-A.
Figure 21:
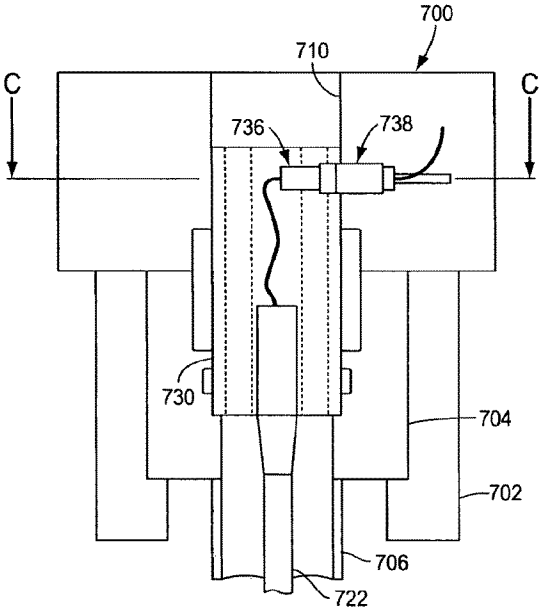
FIG. 21 is a representation of a christmas tree shown with yet another embodiment of the ESP power feedthrough arrangement of the present invention.

A further downhole equipment power supply arrangement is shown in FIGS. 21-22. The power supply arrangement of this embodiment is similar in most respects to the power supply arrangement just described in connection with FIGS. 19-20. In the present embodiment, however, the suspension string 722 is connected to a single three-pin wet mate connector half 736 in the downhole equipment hanger 730 which is configured to be engaged by a corresponding single three-pin wet mate connector half 738 in the VXT 700.

Figure 23:
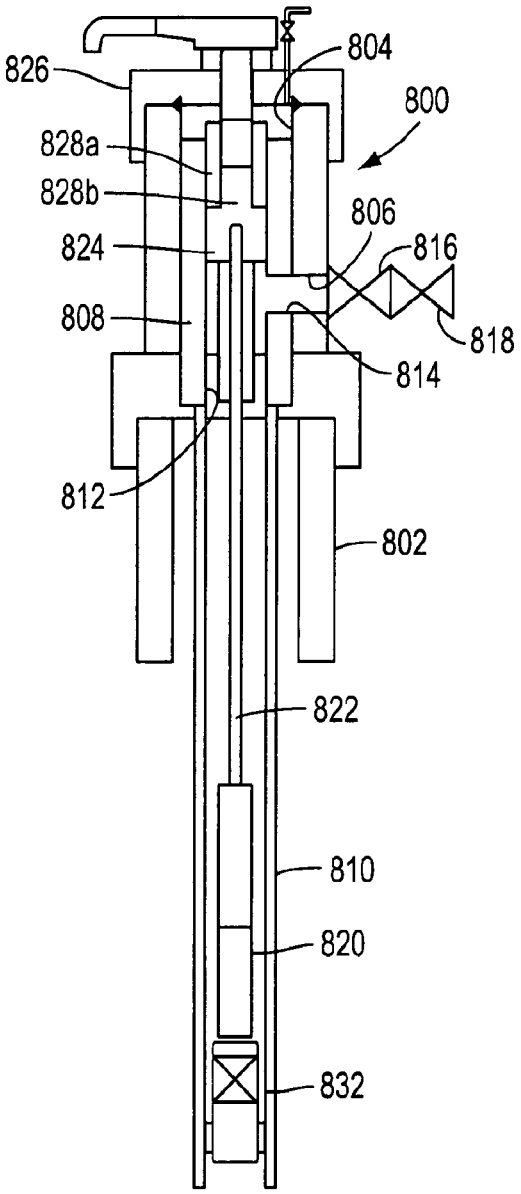
FIG. 23 is a representation of an exemplary horizontal christmas tree shown with a further embodiment of the ESP power feedthrough arrangement of the present invention.
Figure 24:
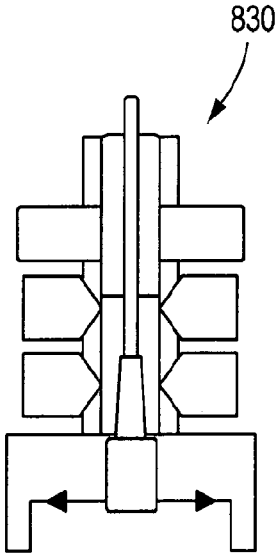
FIG. 24 is a representation of a WCP interface which is configured for use with the tree of FIG. 23.

In accordance with the present invention, the innovative aspects of the downhole equipment power supply arrangements described above can also be applied to horizontal christmas trees. Referring to FIGS. 23-24, a typical horizontal christmas tree ("HXT"), generally 800, is shown installed on a wellhead 802 located at the upper end of a well bore. The HXT 800 includes a vertically extending central bore 804 and a laterally extending production outlet 806. A tubing hanger 808 is landed in the central bore 804 and supports a production tubing string 810 which extends into the well bore. The tubing hanger 808 comprises an axially extending tubing hanger production bore 812 which is connected to the production tubing 810 and a laterally extending side port 814 which extends between the tubing hanger production bore and the production outlet 806 of the HXT 800. The flow of well fluids through the HXT 800 is controlled at least in part by barrier elements such as a PMV 816 and a PWV 818 which are provided in the production outlet 806.

In the embodiment shown in FIG. 23, the downhole equipment, such as an ESP 820, is suspended from a suspension string 822 which is connected to a downhole equipment hanger 824. The downhole equipment hanger 824 is locked and sealed in, e.g., a crown plug profile in the tubing hanger production bore 812 above the side port 814. A pressure-containing tree cap 826 is connected to the top of the HXT 800, and power and/or utilities to the ESP 820 are conveyed through a power feedthrough to a wet mate connector half 828*a*. The wet mate connector half 828*a* in the tree cap 826 is in turn connected to a corresponding wet mate connector half 828*b* in the downhole equipment hanger 824.

During the production mode of operation of the HXT 800, the downhole equipment hanger 824 and the tree cap 826 provide two pressure barriers between the well bore and the environment. In the event the ESP 820 should need to be replaced, the tree cap 826 can be removed and an interface 830 (FIG. 24) similar to the interface 612 described above can be connected to the top of the HXT 800. During this operation, one or more downhole valves 832 located in the production tubing 810 below the ESP 820 provide a second pressure barrier between the well bore and the environment. After the interface 830 is connected to the HXT 800, the ESP 820 can be retrieved and a new ESP installed. The interface 830 may then be removed and the tree cap 826 reinstalled to establish power and/or utilities to the new ESP 820.

Figure 25:
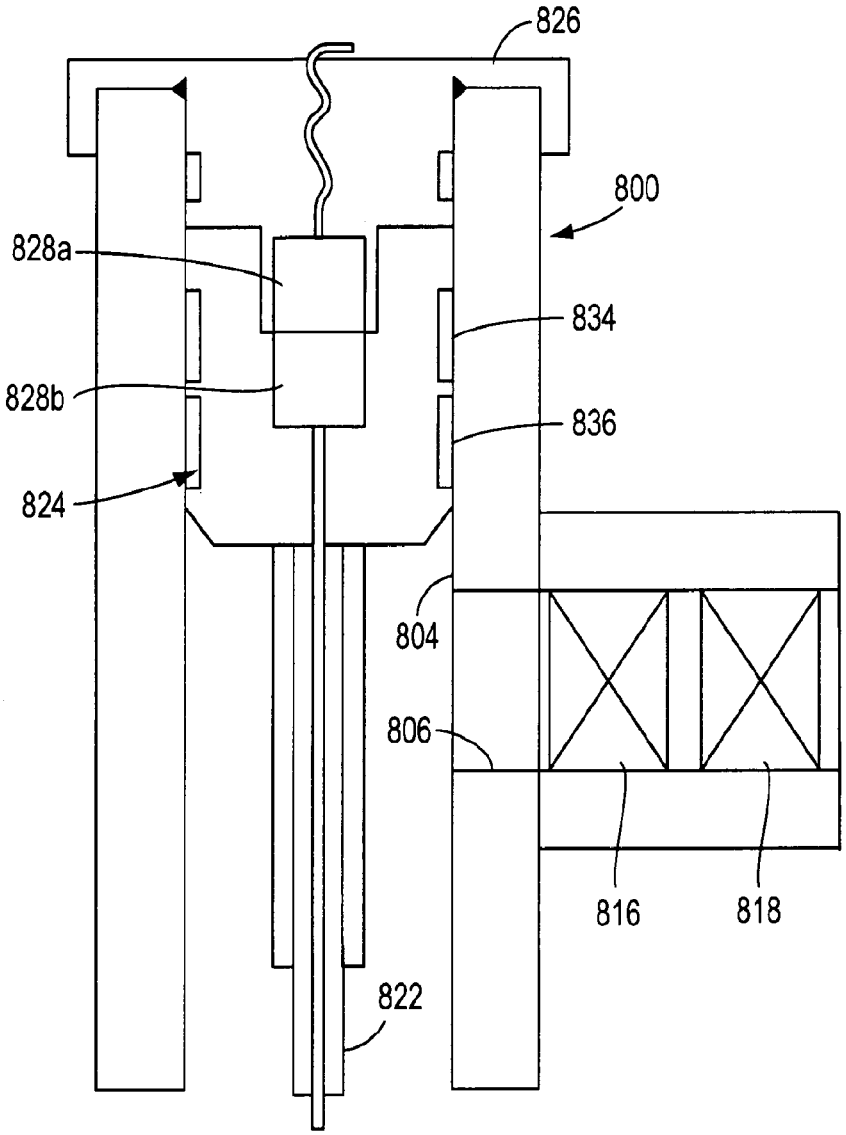
FIG. 25 is an enlarged representation of an exemplary horizontal christmas tree shown with an additional embodiment of the ESP power feedthrough arrangement of the present invention.

An alternative embodiment of the HXT 800 is shown in FIG. 25. In FIG. 25 the tubing hanger has been removed for clarity. In this embodiment, the downhole equipment hanger 824 is positioned in the central bore 804 of the HXT 800 above the tubing hanger (not shown). In addition, the downhole equipment hanger 824 is sealed to the central bore 804 by dual radial seals 834, 836. All other aspects of this embodiment of the invention are as described above in connection with FIG. 23.

Figure 26:
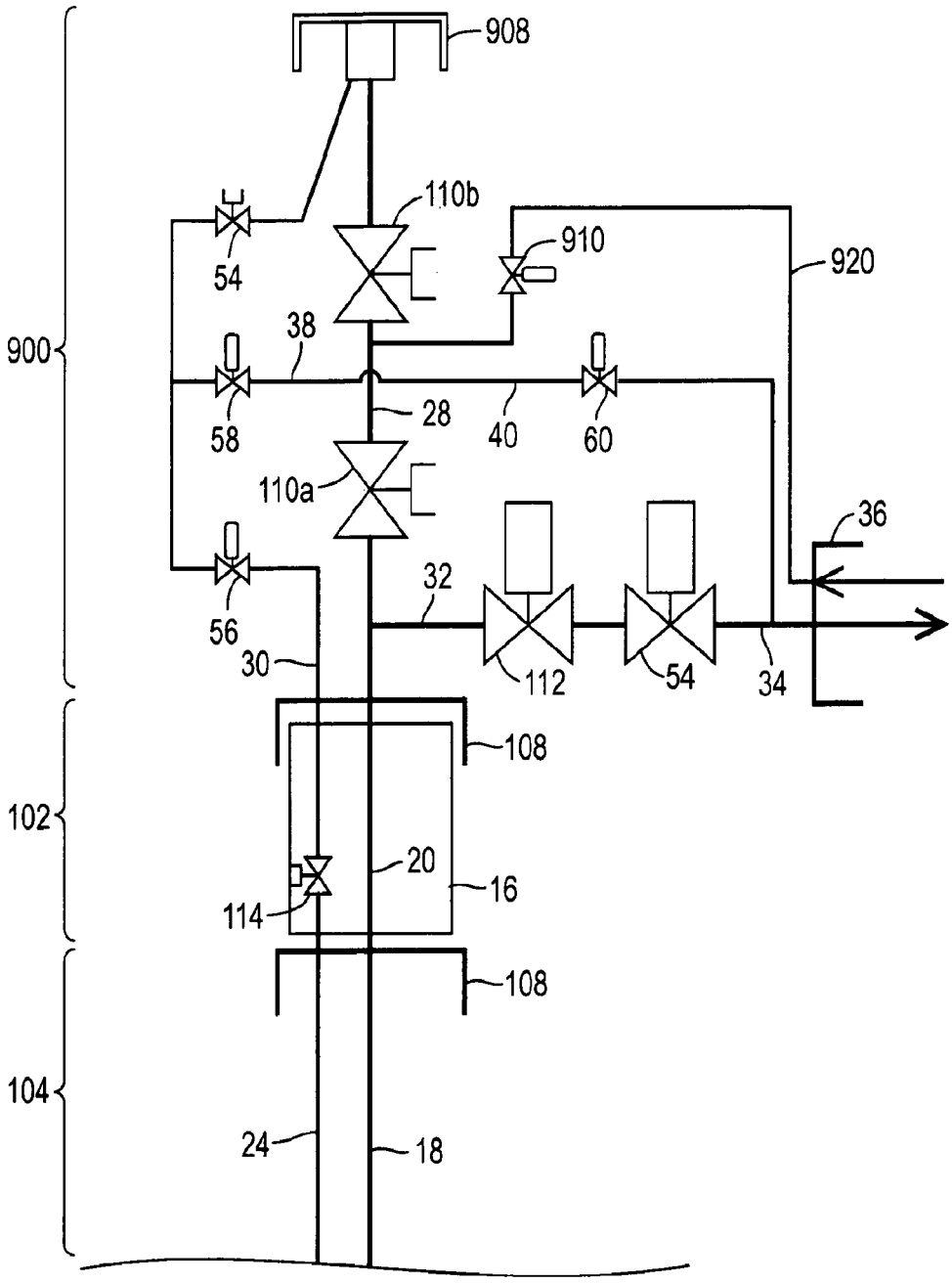
FIG. 26 is a schematic representation of a further embodiment of the christmas tree of the present invention.
Figure 27:
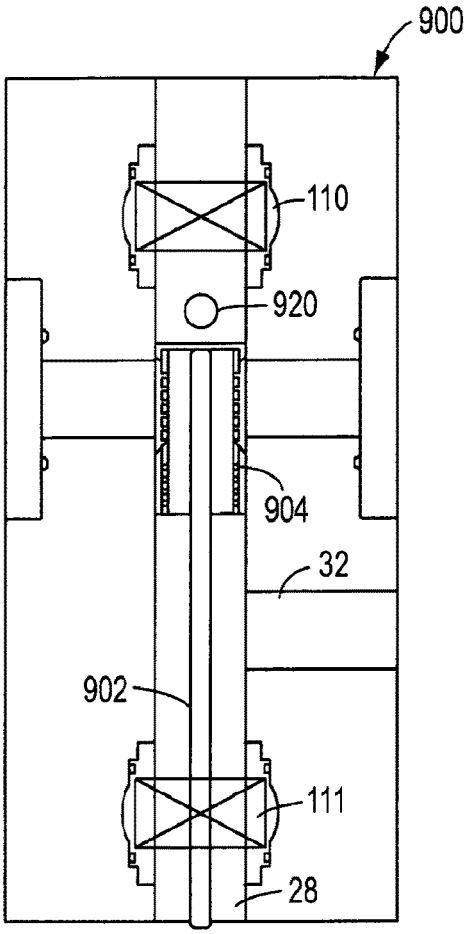
FIGS. 27 and 28 are enlarged views of the tree of FIG. 26, but with a PIV shown below the production outlet instead of a PSV above the production outlet, as in FIG. 26.
Figure 28:
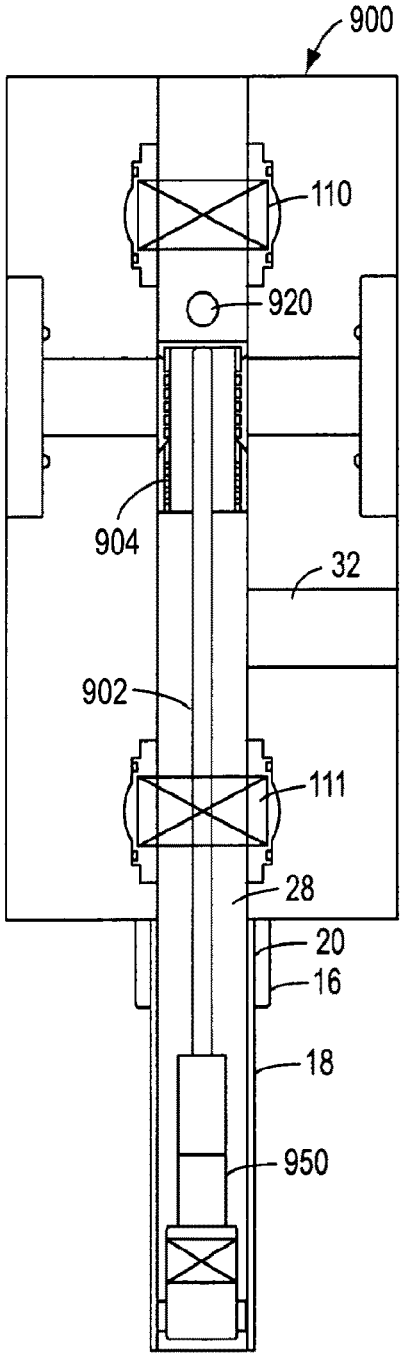

An alternative embodiment of the christmas tree of the present invention is shown in FIG. 26-28. The christmas tree of this embodiment, generally 900, is similar in many respects to the tree 100 described above in connection with FIG. 2. Accordingly, the tree 900 is mounted on a tubing head 102 which in turn is mounted on a wellhead 104. A tubing hanger 16 from which a production tubing string 18 is suspended is landed in the tubing head 102 in the same manner as in the embodiment of FIG. 2. As with the tree 100, the tree 900 includes a number of barrier elements and closure devices for controlling the flow of fluid through the production bore 28, the production outlet 32, the annulus bore 30 and the annulus outlet 38. For example, an LPSV 110*a* and an UPSV 110*b* may be provided in the production bore 28 above the production outlet 32, as shown in FIG. 26, or a PSV 110 may be provided in the production bore above the production outlet and a PIV 111 may be provided in the production bore below the production outlet, as shown in FIGS. 27 and 28.

In the present embodiment, the tree 900 includes a number of features for supplying fluid power to a hydraulic submersible pump ("HSP") 950 (FIG. 28). The HSP 950 is connected to a suspension string in the form of a fluid power conduit 902 which extends through tubing string 18 and the tubing hanger production bore 20 and is connected to a downhole equipment hanger 904. The downhole equipment hanger 904 is landed and sealed in the production bore 28 above the production outlet 32 in the same manner as the downhole equipment hanger 604 shown in FIG. 12. The fluid power conduit 902 communicates with an HSP conduit 920 having a first end which is connected to the flowline connector 36, shown in FIG. 26, and a second end which is connected to the production bore 32 below the PSV 110 and above both the production outlet 32 and the downhole equipment hanger 904, shown in FIG. 28. A preferably hydraulically or electrically actuated HSP valve 910, shown in FIG. 26, is positioned in the HSP conduit 920 to control the flow of fluid power to the HSP 950.

Thus, the tree 900 facilitates the use of an HSP in subsea hydrocarbon production systems. Traditionally, an HSP is powered by pumping the power fluid through the annulus of the tree and down the well bore annulus to a crossover sub in the production tubing which is connected to the HSP. In the present embodiment, because the production bore of the tree can accommodate a large through bore, the power conduit 902 and the production from the well can be accommodated in the production tubing, eliminating the need to expose the annulus to power fluid pressures. Fluid power for the HSP 950 can be supplied by any number of pressure sources and can be any of a variety of types of fluids or fluid mixtures that are delivered to the flowline connector 36. The fluid power travels via the HSP conduit 920, through the HSP valve 910 and into the production bore 28. With the PSV 48 in the closed position, the fluid is directed through the downhole equipment hanger 904 and into the fluid power conduit 902. The fluid power then travels to the HSP 950 and is exhausted into the production tubing string 18, where it is mixed with hydrocarbons and travels up the production tubing string 18 to the tubing hanger production bore 20, then to the production bore 28, and exits the tree 900 through the production outlet 32. The fluid power can be routed to the production bore 28 in any number of ways which are obvious to those skilled in the art. FIGS. 26-28 illustrates just one of the possible arrangements.

Figure 29:
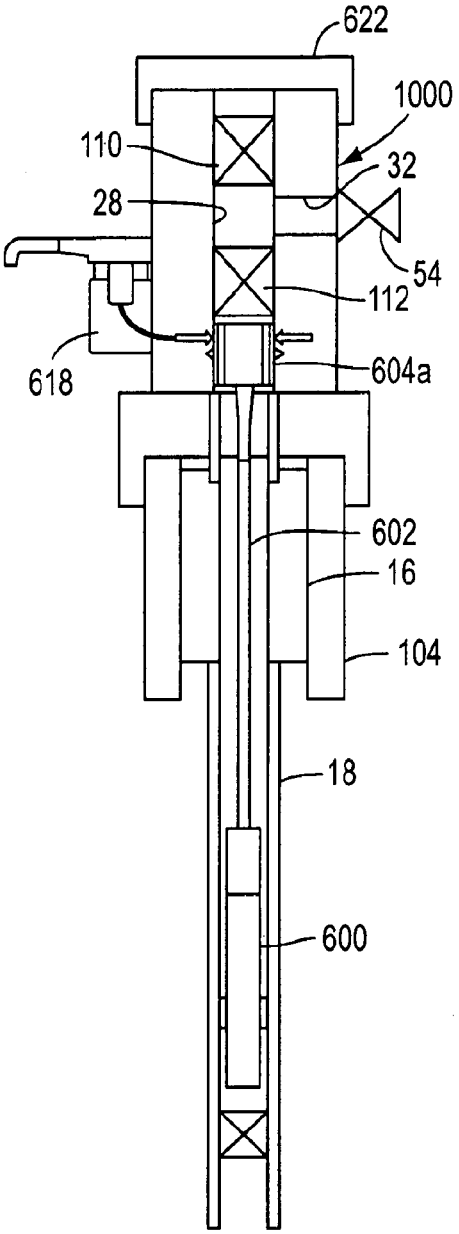
FIGS. 29-31 are representations of further embodiments of the christmas tree of the present invention.

Another embodiment of the christmas tree of the present invention is shown in FIG. 29. The christmas tree of this embodiment, generally 1000, is a vertical christmas tree which is similar in many respects to the christmas tree 200 described above. In the present embodiment, however, the PIV 111 in the production bore 28 below the production outlet 32 is replaced with a barrier element such as a PMV 112. Also, an ESP 600 or other downhole equipment device is suspended on an suspension string 602 from a flow-through downhole equipment hanger 604*a* which is landed and locked in the production bore 28 below the PMV 112. Power for the ESP 600 is supplied via a radial wet mate connector half 618 which is mounted to the tree 1000 and engages with a corresponding wet mate connector half located in the downhole equipment hanger 604*a*.

Like the PWV 54, the PMV 112 is a hydraulically or electrically actuated, FSC valve. Because the tree 1000 employs only one hydraulically or electrically actuated valve in the production bore 28, the overall size of the tree can be made smaller than a conventional tree with two hydraulically or electrically actuated valves in the production bore. At the same time, during the production mode of operation of the tree 1000, double barrier protection between the well bore and the environment is provided by a PSV 110 located in the production bore 28 above the production outlet 32 and a pressure containing tree cap 622.

Figure 30:
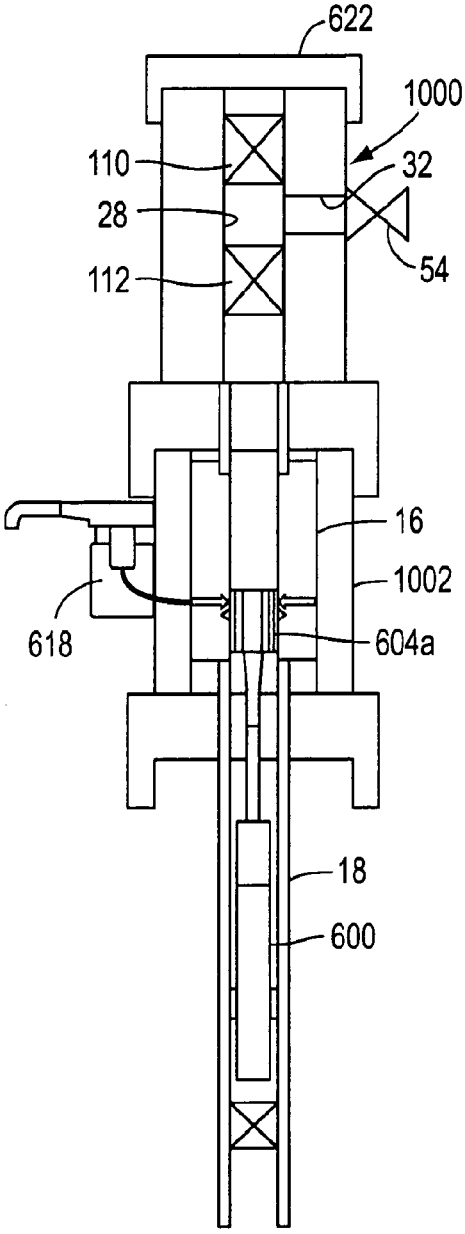
Figure 31:
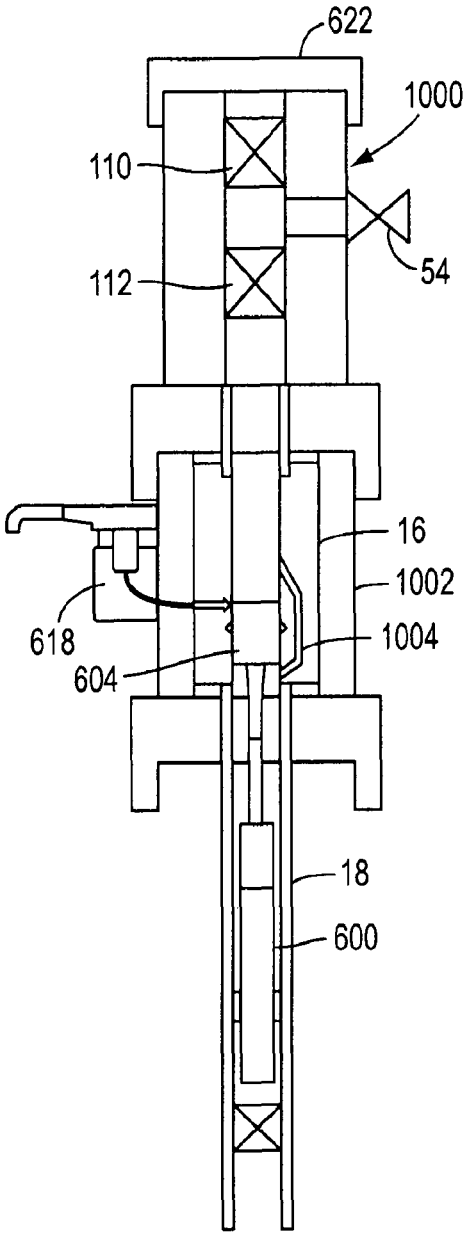

Alternative embodiments of the christmas tree 1000 are shown in FIGS. 30 and 31. In FIG. 30, the christmas tree 1000 is mounted on a tubing head 1002 which in turn is mounted on the wellhead (not shown). The tubing hanger 16 is landed in the tubing head 1002 and the ESP 600 or other downhole equipment device is suspended from a flow-through downhole equipment hanger 604*a* which is landed and locked in the tubing hanger. Power for the ESP 600 is supplied via a radial wet mate connector half 618 which is mounted to the tubing head and engages with a corresponding wet mate connector half located in the downhole equipment hanger 604*a*.

The embodiment of the invention shown in FIG. 31 is similar in most respects to the embodiment shown in FIG. 30. However, instead of a flow-through downhole equipment hanger 604*a*, the ESP 600 or other downhole equipment device is suspended from a downhole equipment hanger 604 of the type described above and well fluids are communicated around the hanger by a number of bypass flow ports 1004 in the tubing hanger 16.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the following claims are to be construed to cover all equivalents falling within the true scope and spirit of the invention.

What is claimed is:

1. A subsea hydrocarbon production system which comprises:

a tubing hanger which is positioned at an upper end of a well bore, the tubing hanger including a tubing hanger production bore;

a tubing string which extends from the tubing hanger into the well bore and is fluidly connected to the tubing hanger production bore;

a christmas tree which is positioned above the tubing hanger and which comprises:

a production bore which is fluidly connected to the tubing hanger production bore;

a production outlet which is connected to the production bore;

a first barrier element which is positioned in the production outlet; and a first closure device which is positioned in the production bore above the production outlet;

wherein access from above the christmas tree through the production bore does not require passage through a barrier element;

a downhole equipment device which is positioned in the tubing string, the downhole equipment device being connected to a suspension string which is connected to a downhole equipment hanger that is secured to the production bore above the production outlet;

wherein the downhole equipment device is installed through the first closure device.

2. The subsea hydrocarbon production system of claim 1, further comprising:

a second closure device which is positioned in the production bore below the production outlet;

wherein the downhole equipment device is installed through both the first and second closure devices.

3. The subsea hydrocarbon production system of claim 1, wherein an end of the suspension string located in the downhole equipment hanger is connected to an external power supply by a wet mate connector.

4. The subsea hydrocarbon production system of claim 3, wherein the wet mate connector is connected to a power and/or utility feed through in a tree cap which is secured and sealed to the top of the christmas tree.

5. The subsea hydrocarbon production system of claim 4, wherein the downhole equipment hanger is positioned below the first closure device and the wet mate connector is configured to extend through the first closure device.

6. The subsea hydrocarbon production system of claim 3, wherein the end of the suspension string is connected to a wet mate connector half which is configured to be engaged by a radial wet mate connector half mounted on the christmas tree.

7. A subsea hydrocarbon production system which comprises:

a tubing hanger which is positioned at an upper end of a well bore, the tubing hanger including a tubing hanger production bore;

a tubing string which extends from the tubing hanger into the well bore and is fluidly connected to the tubing hanger production bore;

a christmas tree which is positioned above the tubing hanger and which comprises:

a production bore which is fluidly connected to the tubing hanger production bore;

a production outlet which is connected to the production bore;

a first barrier element which is positioned in the production outlet; and a first closure device which is positioned in the production bore above the production outlet;

wherein access from above the christmas tree through the production bore does not require passage through a barrier element;

a downhole equipment device which is positioned in the tubing string, the downhole equipment device being connected to a suspension string which is connected to a downhole equipment hanger that is secured to the tubing hanger production bore;

wherein the downhole equipment hanger is located below the first closure device.

8. The subsea hydrocarbon production system of claim 7, further comprising:

a second closure device which is positioned in the production bore below the production outlet;

wherein the downhole equipment hanger is located below both the first and second closure devices.

9. The subsea hydrocarbon production system of claim 7, wherein the downhole equipment hanger comprises a number of axial through bores which permit the passage of fluid through the tubing hanger production bore.

10. The subsea hydrocarbon production system of claim 7, wherein an end of the suspension string located in the downhole equipment hanger is connected to an external power supply by a wet mate connector.

11. The subsea hydrocarbon production system of claim 10, wherein the end of the suspension string is connected to a wet mate connector half which is configured to be engaged by a radial wet mate connector half mounted on the christmas tree.

12. The subsea hydrocarbon production system of claim 7, wherein an end of the suspension string located in the downhole equipment hanger is connected via a suspension string extender to a termination head which in turn is connected to an external power supply by a wet mate connector.

13. The subsea hydrocarbon production system of claim 12, wherein the wet mate connector is connected to a power and/or utility feed through in a tree cap which is secured and sealed to the top of the christmas tree.

14. The subsea hydrocarbon production system of claim 13, wherein the downhole equipment hanger is positioned below the first closure device and the wet mate connector is configured to extend through the first closure device.

15. The subsea hydrocarbon production system of claim 12, wherein the termination head is connected to a wet mate connector half which is configured to be engaged by a radial wet mate connector half mounted on the christmas tree.

16. A subsea hydrocarbon production system which comprises:

a tubing hanger which is positioned at an upper end of a well bore, the tubing hanger including a tubing hanger production bore;

a tubing string which extends from the tubing hanger into the well bore and is fluidly connected to the tubing hanger production bore;

a christmas tree which is positioned above the tubing hanger and which comprises:

a production bore which is fluidly connected to the tubing hanger production bore;

a production outlet which is connected to the production bore;

a first barrier element which is positioned in the production outlet; and a first closure device which is positioned in the production bore above the production outlet;

wherein access from above the christmas tree through the production bore does not require passage through a barrier element;

a hydraulic submersible pump which is positioned in the tubing string, the pump including a fluid power conduit which is connected to a downhole equipment hanger that is secured to the production bore above the production outlet and below the first closure device; and a pump conduit having a first end which is connectable to a source of pressurized fluid and a second end which is connected to the production bore below the first closure device and above the downhole equipment hanger;

wherein with the first closure device closed, pressurized fluid is communicated through the pump conduit, the production bore and the fluid power conduit to activate the pump.

17. The subsea hydrocarbon production system of claim 16, wherein fluid exhausted by the pump exits the production bore through the production outlet.

18. The subsea hydrocarbon production system of claim 16, further comprising a pump valve for controlling the flow of pressurized fluid through the pump conduit.

19. A subsea hydrocarbon production system which comprises:

a tubing hanger which is positioned at an upper end of a well bore, the tubing hanger including a tubing hanger production bore;

a tubing string which extends from the tubing hanger into the well bore and is fluidly connected to the tubing hanger production bore;

a christmas tree which is positioned above the tubing hanger and which comprises:

an axially extending tree production bore which is connected to the tubing hanger production bore;

a laterally extending production outlet which is connected to the tree production bore;

a first barrier element which is positioned in the production outlet; and a second barrier element which is positioned in the tree production bore below the production outlet;

a downhole equipment device which is positioned in the tubing string and is connected to a suspension string which in turn is connected to a downhole equipment hanger;

wherein the downhole equipment hanger is landed in one of the tubing hanger production bore or the tree production bore below the second barrier element.

20. The subsea hydrocarbon production system of claim 19, wherein the downhole equipment hanger comprises a number of axial through bores which permit the passage of fluid through the tubing hanger production bore and the tree production bore.

21. The subsea hydrocarbon production system of claim 19, wherein the downhole equipment hanger is landed in the tubing hanger production bore.

22. The subsea hydrocarbon production system of claim 21, wherein the downhole equipment hanger comprises a wet mate connector half to which an end of the suspension string is connected and which is configured to be engaged by a radial wet mate connector half for the supply of power and/or utilities to the downhole equipment device.

23. The subsea hydrocarbon production system of claim 22, wherein the tubing hanger is landed in a wellhead located below the christmas tree and the radial wet mate connector is mounted on the wellhead.

24. The subsea hydrocarbon production system of claim 22, wherein the tubing hanger is landed in a tubing head located below the christmas tree and the radial wet mate connector is mounted on the tubing head.

25. The subsea hydrocarbon production system of claim 22, wherein a portion of the downhole equipment hanger extends into the tree production bore and the radial wet mate connector is mounted on the christmas tree.

26. The subsea hydrocarbon production system of claim 19, wherein the downhole equipment hanger is landed in the tree production bore.

27. The subsea hydrocarbon production system of claim 26, wherein the downhole equipment hanger comprises a wet mate connector half to which an end of the suspension string is connected and which is configured to be engaged by a radial wet mate connector half mounted on the christmas tree for the supply of power and/or utilities to the downhole equipment device.

28. The subsea hydrocarbon production system of claim 19, wherein the downhole equipment hanger is landed in the tubing hanger production bore and the tubing hanger comprises a number of axially extending bypass flow ports which permit the passage of fluid around the downhole equipment hanger.

* * * * *